US008861988B2

(12) United States Patent
Lawniczak

(10) Patent No.: US 8,861,988 B2
(45) **Date of Patent: *Oct. 14, 2014**

(54) EDGE PRINTING METHOD

(75) Inventor: Gary P. Lawniczak, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 430 days.

This patent is subject to a terminal disclaimer.

(21) Appl. No.: 13/285,592

(22) Filed: Oct. 31, 2011

(65) Prior Publication Data

US 2013/0104759 A1 May 2, 2013

(51) Int. Cl.
*G03G 15/00* (2006.01)
*B41F 7/02* (2006.01)

(52) U.S. Cl.
CPC ..... *B41F 7/02* (2013.01)
USPC ..... 399/16; 399/388

(58) Field of Classification Search
CPC G03G 15/00; G03G 15/5025; G03G 15/6594
USPC ..... 399/16, 23, 38, 82, 388
See application file for complete search history.

(56) References Cited

U.S. PATENT DOCUMENTS 6,980,767 B1 * 12/2005 Cahill et al. ..... 399/408
2012/0027439 A1 * 2/2012 Lawniczak et al. ..... 399/40

FOREIGN PATENT DOCUMENTS

JP 2010-020076 1/2010

* cited by examiner

*Primary Examiner* — Ren Yan
(74) *Attorney, Agent, or Firm* — Roland R. Schindler; Peyton C. Watkins

(57) ABSTRACT

In methods for operating a printer a sheet is provided in a printing path leading to a printing area, a receiver is provided having a cross edge to which a printed image is to extend in the printing path for movement with the sheet. The receiver and the sheet are moved through the printing area so that the cross edge is moved through printing area during transfer of a toner to form the print image. The receiver and the sheet are further moved through the printing area with the cross edge of positioned on the sheet to separate a portion of the sheet that is masked from transfer of the print image from an unmasked portion of the sheet and the unmasked portion of the sheet is positioned to receive any portion of the print image that is transferred when the receiver is not in the printing area.

16 Claims, 26 Drawing Sheets

EDGE PRINTING METHOD

CROSS REFERENCE TO RELATED APPLICATIONS

This application relates to commonly assigned, copending U.S. application Ser. No. 13/285,615 filed Oct. 31, 2011, entitled: "EDGE PRINTING PRINTER"; U.S. application Ser. No. 13/285,649, filed Oct. 31, 2011, entitled: "EDGE PRINTING MODULE" and U.S. application Ser. No. 13/285,666, filed Oct. 31, 2011, entitled: "METHOD FOR OPERATING A PRINTING MODULE FOR EDGE PRINTING", each of which is hereby incorporated by reference.

FIELD OF THE INVENTION

This invention pertains to the field of printing.

BACKGROUND OF THE INVENTION

Many consumers prefer the appearance of a borderless print that has one or more images that extend to one or more edges of the print as compared to a print having a border region around the printed image. However, it can be difficult to precisely align a leading edge of a print image with a leading edge of a receiver during printing. In particular, variations in machine tolerances, machine wear, receiver lengths and environmental conditions, among other things, can make it difficult for automatic printing and receiver movement systems in a printer to consistently achieve the precise alignment required to make a print having a printed image that extends to an edge of the receiver.

It will be appreciated that even minor errors in alignment can significantly impact the appearance of the print. For example, minor errors in alignment can cause a leading edge of a receiver to move through a printing position before printing at the leading edge begins. When this happens, there will be an unprinted portion of the receiver at the leading edge of the receiver yielding a print having a border. Similarly, where an error in alignment causes image printing to end before a trailing edge of a print has reached a printing position, there can be an unprinted portion of the receiver at the trailing edge of the receiver. When this happens, there will be an unprinted portion of the receiver at the trailing edge of the receiver yielding a print having a border.

Minor errors in alignment can significantly impact the appearance of a print in other ways. For example, in a printer that uses toner to form toner images on a receiver such errors can cause a toner image to begin transfer before a receiver is positioned to receive transferred toner or to finish transferring after the receiver is no longer positioned to receive transferred toner. Toner that is not transferred onto a receiver will be transferred onto equipment of the printer and can interfere with subsequent printer operations. For example, where such toner is transferred onto a component of the printer that contacts receivers, there is a risk that the transferred toner will be deposited on a subsequent receiver to create unintended print artifacts. Additionally, there is a risk that such toner can be disbursed within the printer and can accumulate in places that interfere with the proper operation of the printer.

In some printers, such as the NexPress 2100 sold by Eastman Kodak Company, Rochester, N.Y., USA and subsequent printers from this family of products toner images are on a receiver that is oversized with respect to a desired print size. During a finishing operation, the print is cut to the desired print size with the cutting being done within or along the printed area so that the finished print has an image that extends to at least one of the newly cut edges of the finished print.

This print-and-cut process wastes receiver material and imposes several burdens on the printing process. For example, the print-and-cut process can introduce a risk of a cutting error as the cutting used in such a process must be precisely aligned with the edge of the image so as to avoid leaving a portion of the border on the cut receiver and so as to avoid cutting potentially desirable portions of the image content from the receiver. Further, this print-and-cut process can significantly reduce printing efficiency when the edge to which the toner image is to extend is a leading or trailing edge of the receiver. This is because it is necessary to suspend movement of the receiver along a printing path to allow such leading or trailing edges of a receiver to be cut. Additionally, this print-and-cut process creates a print having one or more cut edges that may have a different appearance than other edges of the print.

The print-and-cut process further creates problems where the desired print has an edge that is not straight, such as a scalloped, cured or saw toothed edge as such edges must be cut with an adaptive cutting tool such as the Circuit tool or must be cut using a patterned dye. It is both complex and expensive to provide tools for cutting a bordered print using such tools and to do so in a manner that is aligned with a printed image. However using precut media creates an increased risk of free toner in a printer 20.

One alternative method for providing a print with an image that extends to an edge of a receiver is disclosed in Japanese Patent Publication No. 2010-020076 which describes an image forming apparatus in which an image is formed on a recording material by holding and conveying a recording material in a nip part between an intermediate transfer belt and a secondary transfer belt. The secondary transfer belt is provided with a butting member having a butting part on which a cross-sectional part on a downstream side in a recording material conveying direction out of the recording material carried on the secondary transfer belt. A carrying position of the recording material is determined by allowing the cross-sectional part to butt on the butting part. The butting part protects the cross-sectional part of the receiver member so that the toner is not stuck to the cross-sectional part. However, the presence of the butting part on such a belt limits the range of start positions for printing which can reduce printer efficiency and requires a more complex printer design that can tolerate the passage of the butting part through various nips including any transfer nip and/or fusing nip and that can clean the butting part.

Accordingly, what is needed in the art are printers, printing modules and method for operating the same that enable the production of prints having images that extend to at least one cross edge without requiring cutting of the receiver and without substantially increasing the complexity of the printer, reducing efficiency of the printer or creating limitations on how the printer can be used.

SUMMARY OF THE INVENTION

Methods for operating are provided. In one aspect, a sheet is provided in a printing path leading to a printing area, a receiver is provided having a cross edge to which a printed image is to extend in the printing path for movement with the sheet; and, the receiver and the sheet are moved through the printing area so that the cross edge is moved through printing area during transfer of a toner to form the print image. The receiver and the sheet are further moved through the printing area with the cross edge positioned on the sheet to separate a portion of the sheet that is masked from transfer of the print image from an unmasked portion of the sheet and the unmasked portion of the sheet is positioned to receive any portion of the print image that is transferred when the receiver is not in the printing area.

DETAILED DESCRIPTION OF THE DRAWINGS

Figure 1:
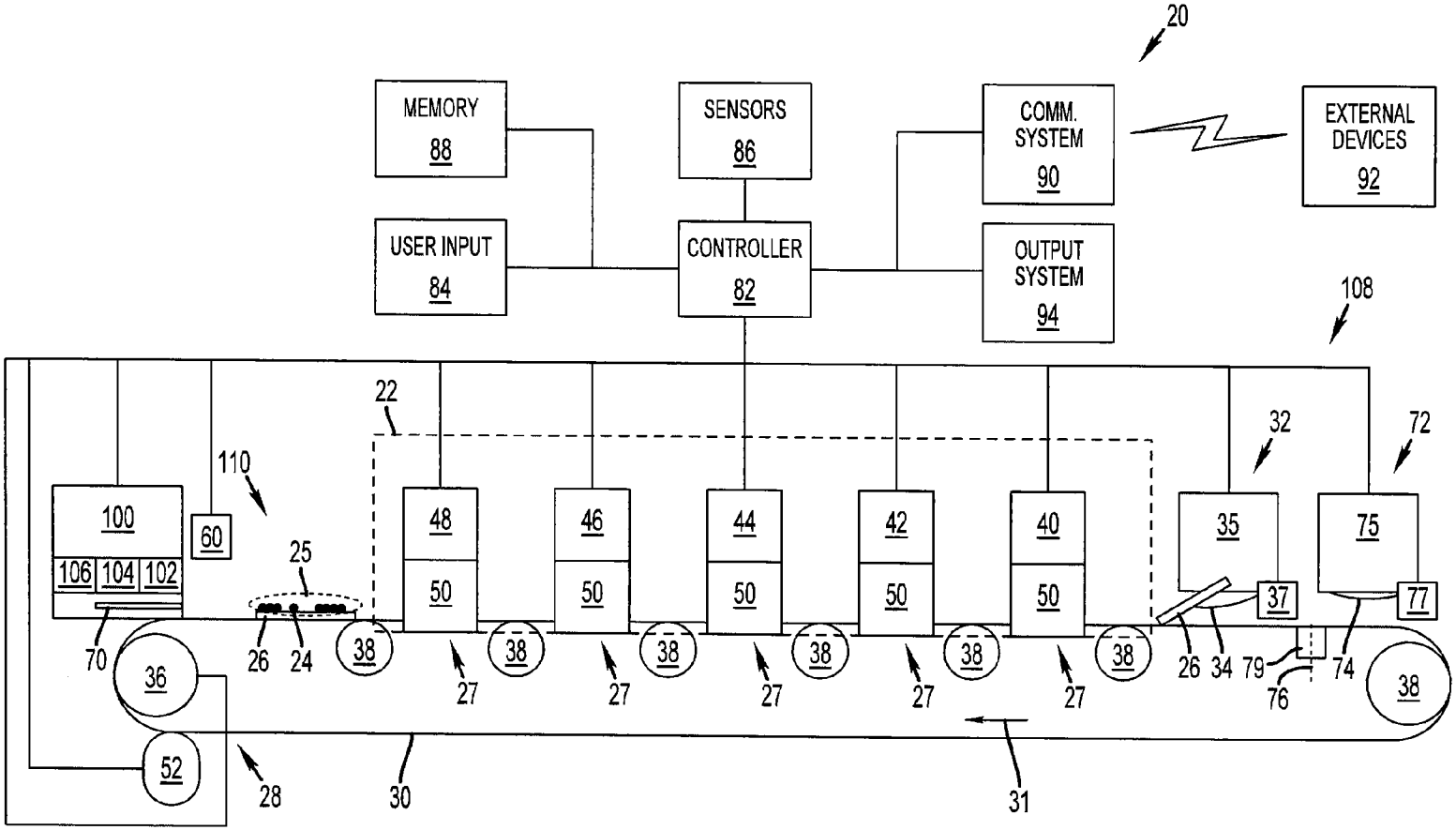
FIG. 1 is a system level illustration of one embodiment of a printer of an electrophotographic type having one embodiment of a lead edge overlap control system.

FIG. 1 is a system level illustration of a printer 20. In the embodiment of FIG. 1, printer 20 has print engine 22 that forms a print image 25 on a receiver 26 as a receiver transport system 28 moves receiver 26 past one or more transfer areas 27 of a print engine 22. In the embodiment that is illustrated in FIG. 1 print engine 22 is of an electrophotographic type that transfers toner 24 to form a print image 25 in the form of a patterned arrangement of toner stacks on receiver 26 as receiver 26 is moved through a transfer area. In this embodiment, print image 25 can include any patternwise application of toner 24 and can be mapped according to data representing text, graphics, photo, and other types of visual content, as well as patterns that are determined based upon desirable structural or functional arrangements of toner 24.

Toner 24 is a material or mixture of a binder material and, optionally, a colorant. Toner 24 typically takes the form of toner particles, and that can form an image, pattern, or coating when electrostatically deposited on an imaging member including a photoreceptor, photoconductor, electrostatically-charged, or magnetic surface. As used herein, "toner particles" are the marking particles that electrostatically develop against electrostatic image to convert an electrostatic latent image toner pattern that corresponds to the electrostatic image and that can be electrostatically transferred to form a pattern on a receiver 26. Toner 24 is also referred to in the art as marking particles or dry ink.

Toner 24 can also include clear particles that have the appearance of being transparent or that while being generally transparent impart a coloration or opacity. Such clear toner particles can provide for example a protective layer on an image or can be used to create other effects and properties on the image. Toner particles can also include functional materials such as materials that have optical, electrical, electromagnetic, mechanical, chemical or other features. The toner particles are fused or fixed to bind toner 24 to a receiver 26.

Particles of toner can have a range of diameters, e.g. less than 8 μm, on the order of 10-15 μm, up to approximately 30 μm, or larger. When referring to particles of toner 24, the toner size or diameter is defined in terms of the median volume weighted diameter as measured by conventional diameter measuring devices such as a Coulter Multisizer, sold by Coulter, Inc. The volume weighted diameter is the sum of the mass of each toner particle multiplied by the diameter of a spherical particle of equal mass and density, divided by the total particle mass. In certain embodiments, toner 24 can also comprise particles that are entrained in a wet carrier.

Typically, receiver 26 takes the form of paper, film, fabric, metal treated or metallic sheets or webs. However, receiver 26 can take any number of forms and can comprise, in general, any article or structure that can be moved relative to print engine 22 and processed as described herein. As is shown in FIG. 1, receiver 26 is moved along a printing path 31 by contact with a movable surface 30 past printing modules 40, 42, 44, 46 and 48, each associated with an individual transfer system 50 so that each module can generate a separate toner image that can be transferred onto receiver 26 as receiver 26 is moved along printing path 31.

Receiver transport system 28 comprises a movable surface 30 that positions receiver 26 relative to print engine 22 so that print engine 22 can deposit one or more applications of toner 24 to form print image 25 on receiver 26. A print image 25 formed from a single application of toner 24 can, for example, provide a monochrome image or layer of a structure. In this embodiment, movable surface 30 is illustrated in the form of an endless belt that is moved by motor 36, that is supported by rollers 38, and that is cleaned by a cleaning mechanism 52.

Print engine 22 can cause a single toner 24 to be transferred to a receiver 26 to form a print image 25 as receiver 26 is moved by receiver transport system 28 through printing area 27. Where more than one print image 25 is transferred onto a receiver 26, the print images 25 can be applied in registration to form a composite print image 25. In such a composite print image 25, different types of toner can be combined at individual areas of a receiver 26 so as to provide controlled combinations of differently colored toners at such areas or to provide different combinations of properties, or for other purposes. For example, in a four color image, four toners having subtractive primary colors, cyan, magenta, yellow, and black, can be combined to form a representative spectrum of colors. Similarly, in a five color image various combinations of any of five differently colored toners can be combined to form other colors on receiver 26 at various locations on receiver 26. That is, any of the five colors of toner 24 can be combined with toner 24 of one or more of the other colors at a particular location on receiver 26 to form a color different than the colors of the toners 24 applied at that location.

In addition to adding to the color gamut, the fifth color can also be a specialty color toner or spot color, such as for making proprietary logos or colors that cannot be produced with only CMYK colors (e.g. metallic, fluorescent, or pearlescent colors), or a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Printer 20 is operated by a printer controller 82 that controls the operation of print engine 22, receiver transport system 28, receiver delivery system 32, transfer system 50, to form a print image 25 on receiver 26 and to cause fuser 60 to fuse print image 25 on receiver 26 to form prints 70 as described herein or as is otherwise known in the art.

Printer controller 82 operates printer 20 based upon input signals from a user input system 84, sensors 86, a memory 88 and a communication system 90. User input system 84 can comprise any form of transducer or other device capable of detecting conditions that are indicative of an action of a user and converting this input into a form that can be used by printer controller 82. For example, user input system 84 can comprise a touch screen input, a touch pad input, a 4-way switch, a 6-way switch, an 8-way switch, a stylus system, a trackball system, a joystick system, a voice recognition system, a gesture recognition system or other such systems. Sensors 86 can include contact, proximity, magnetic, or optical sensors and other sensors known in the art that can be used to detect conditions in printer 20 or in the environment surrounding printer 20 and to convert this information into a form that can be used by printer controller 82 in governing printing, fusing, finishing or other functions. Memory 88 can comprise any form of conventionally known memory devices including but not limited to optical, magnetic or other movable media as well as semiconductor or other forms of electronic memory. Memory 88 can be fixed within printer 20 or removable from printer 20 at a port, memory card slot or other known means for temporarily connecting a memory 88 to an electronic device. Memory 88 can also be connected to printer 20 by way of a fixed data path or by way of communication system 90.

Communication system 90 can comprise any form of circuit, system or transducer that can be used to send signals to or receive signals from memory 88 or external devices 92 that are separate from or separable from direct connection with printer controller 82. Communication system 90 can connect to external devices 92 by way of a wired or wireless connection. In certain embodiments, communication system 90 can comprise any circuit that can communicate with one of external devices 92 using a wired connection such as a local area network, a point-to-point connection, or an Ethernet connection. In certain embodiments, communication system 90 can alternatively or in combination provide wireless communication circuits for communication with separate or separable devices using, for example, wireless telecommunication or wireless protocols such as those found in the Institute of Electronics and Electrical Engineers Standard 802.11 or any other known wireless communication systems. Such systems can be networked or can use point to point communication.

External devices 92 can comprise any type of electronic system that can generate signals bearing data that may be useful to printer controller 82 in operating printer 20. For example and without limitation, one example of such external devices 92 can comprise what is known in the art as a digital front end (DFE), which is a computing device that can be used to provide an external source of a print order that has image information and, optionally, production information including printing information from which the manner in which the images are to be printed can be determined. Optionally, the production data can include finishing information that defines how prints made according to the print order are to be processed after printing. A print order that is generated by such external devices 92 is received at communication system 90 which in turn provides appropriate signals that are received by communication system 90.

Similarly, the print order or portions thereof including image and production data can be obtained from any other source that can provide such data to printer 20 in any other manner, including but not limited to memory 88. Further, in certain embodiments image data and/or production data or certain aspects thereof can be generated from a source at printer 20 such as by use of user input system 84 and an output system 94, such as a display, audio signal source or tactile signal generator or any other device that can be used by printer controller 82 to provide human perceptible signals for feedback, informational or other purposes.

As is shown in FIG. 1, printer 20 further comprises an optional finishing system 100. Finishing system 100 can be integral to printer 20 or it can be separate or separable from printer 20. In the illustrated embodiment finishing system 100 optionally includes a cutting system 102, a folding system 104, and/or a binding system 106. Cutting system 102 can comprise any form of automatic cutting system that can be used to cut a print 70 in at least two parts. Similarly, folding system 104 can comprise any form of automatic folding system that can be used to fold a print 70. Binding system 106 can include conventional wire, ring, staple, or adhesive based systems that apply a material or fastener or that otherwise cause two or more prints 70 to be bound together.

Figure 2:
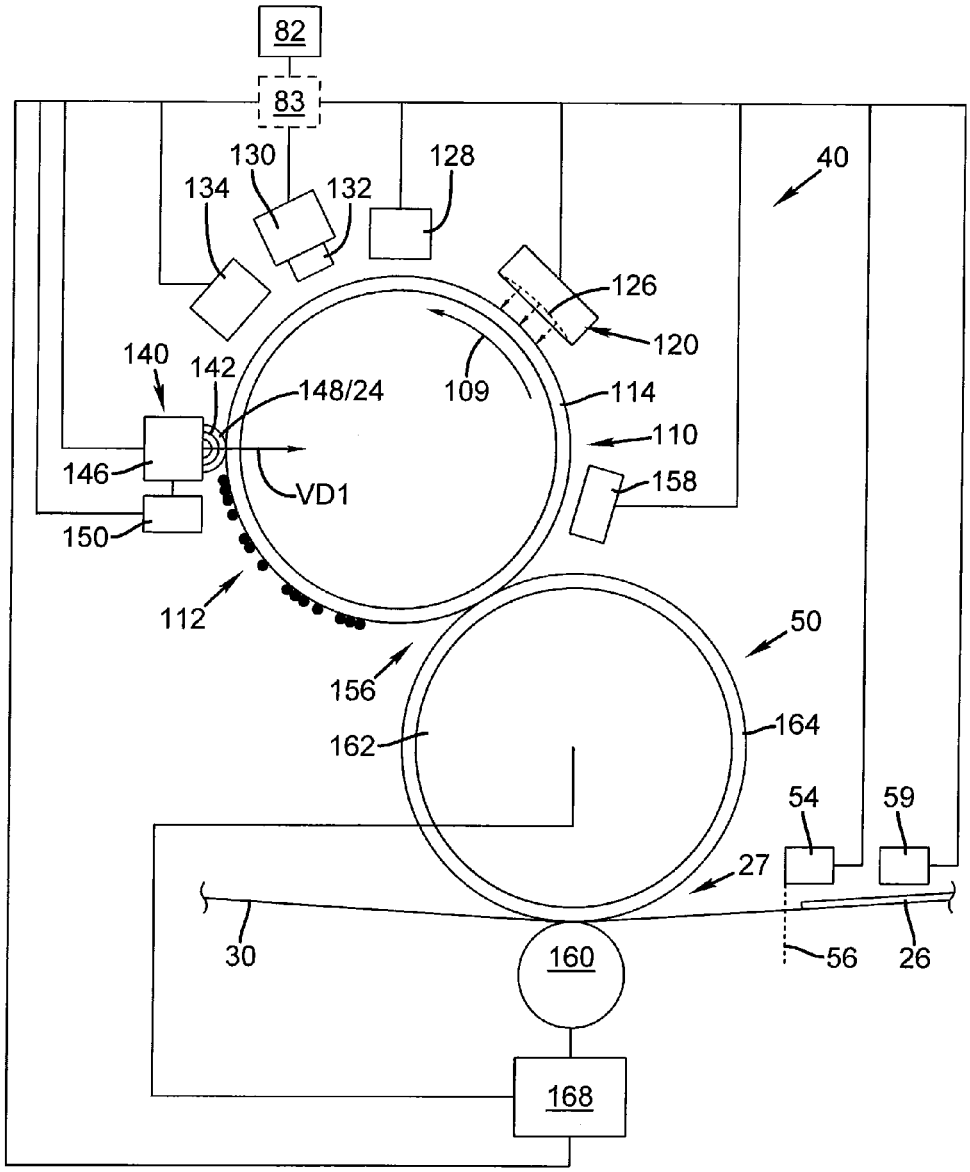
FIG. 2 shows one embodiment of a printing module during toner image formation.
Figure 3:
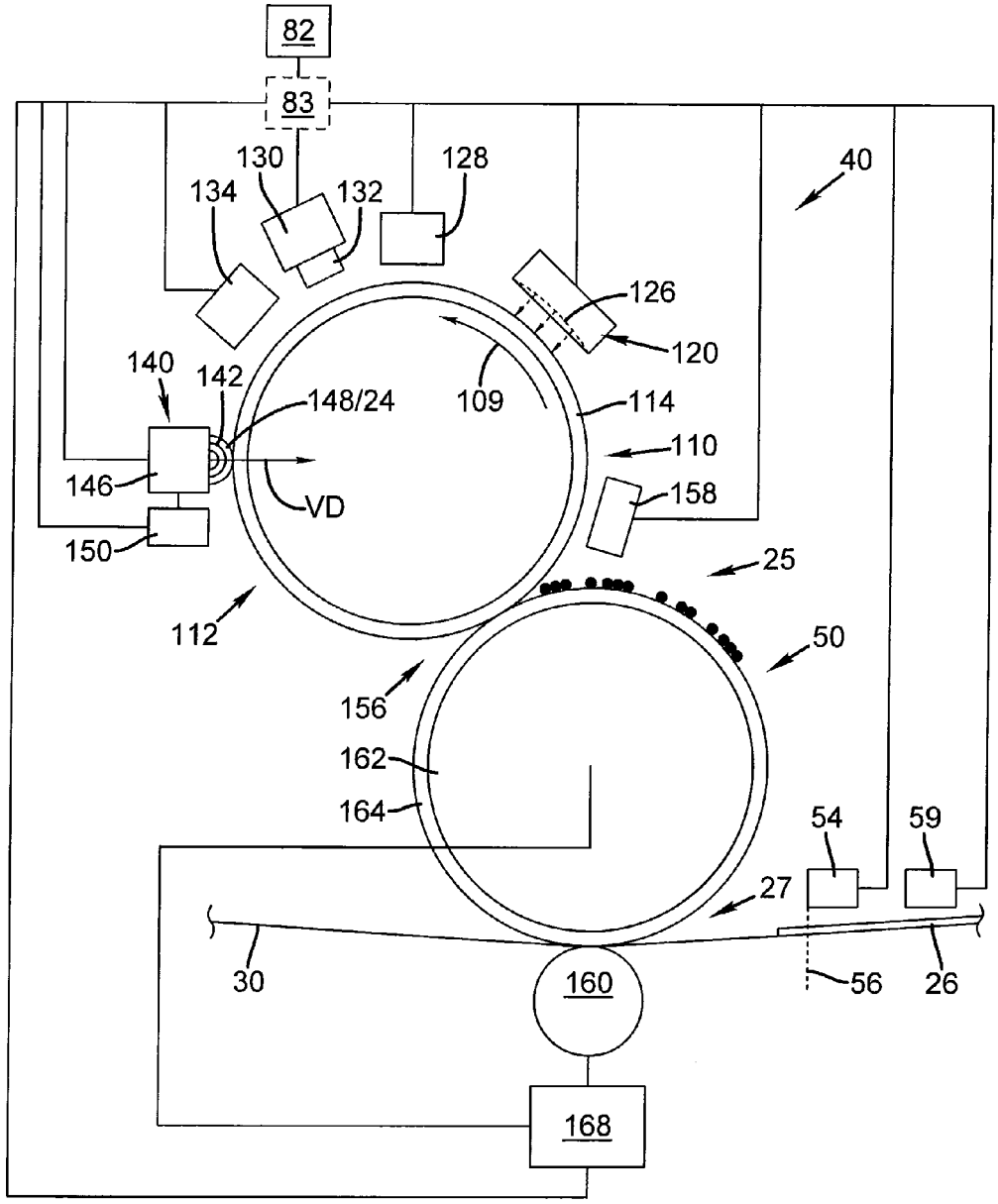
FIG. 3 shows the embodiment of FIG. 1 just after transfer of a toner image to a receiver.
Figure 4:
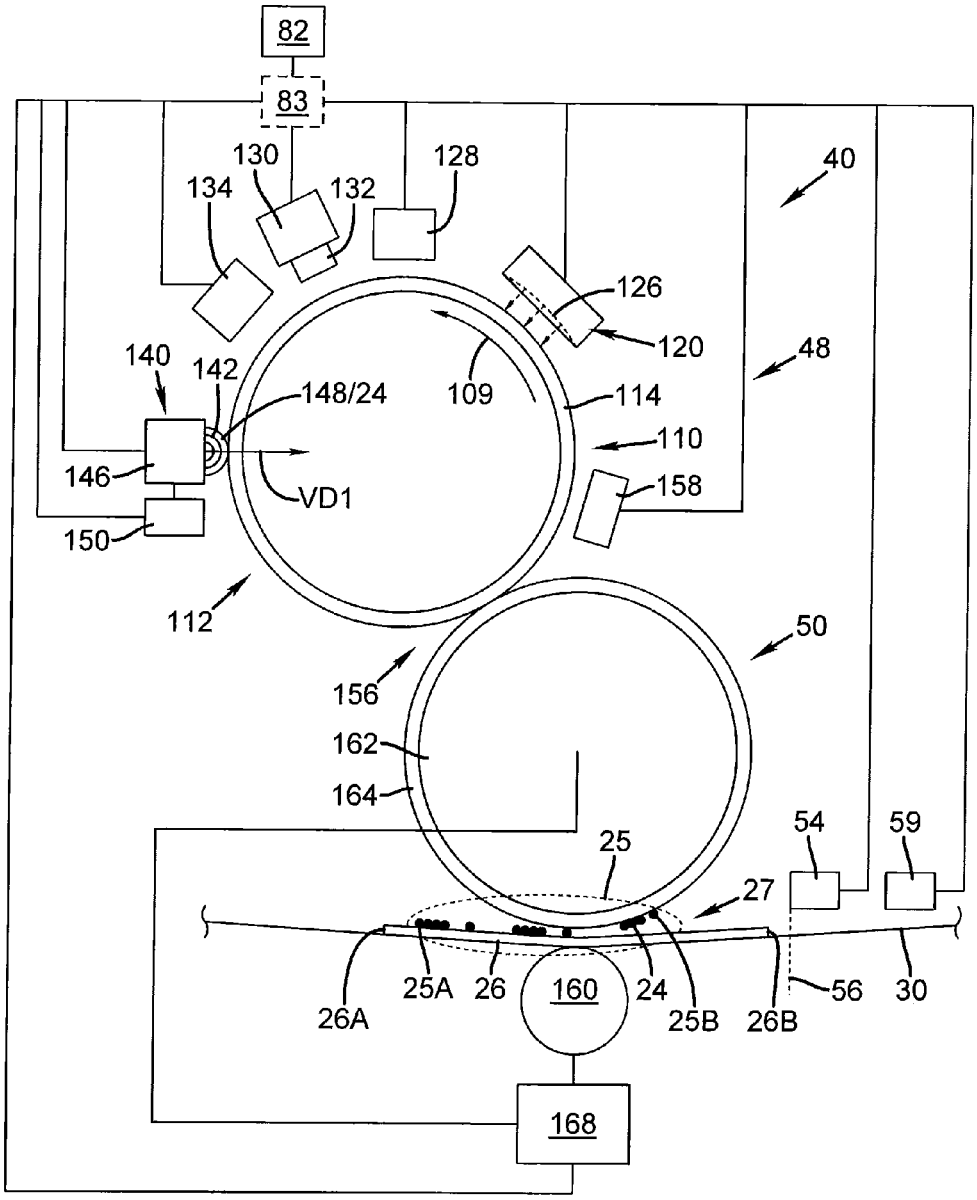
FIG. 4 shows the embodiment of FIG. 1 during transfer of a toner image to a receiver.

In the embodiment of FIG. 1, print engine 22 is shown having five printing modules 40, 42, 44, 46 and 48. FIGS. 2, 3, and 4 show more details of an example of a printing module 40 that is representative of printing modules 42, 44, 46 and 48 of FIG. 1. In this embodiment, printing module 48 has a primary imaging system 110, a charging subsystem 120 having a grid 126 that is selected and driven by a power source, a writing subsystem 130, and a first development station 140 each of which are ultimately responsive to printer controller 82.

Figure 5:
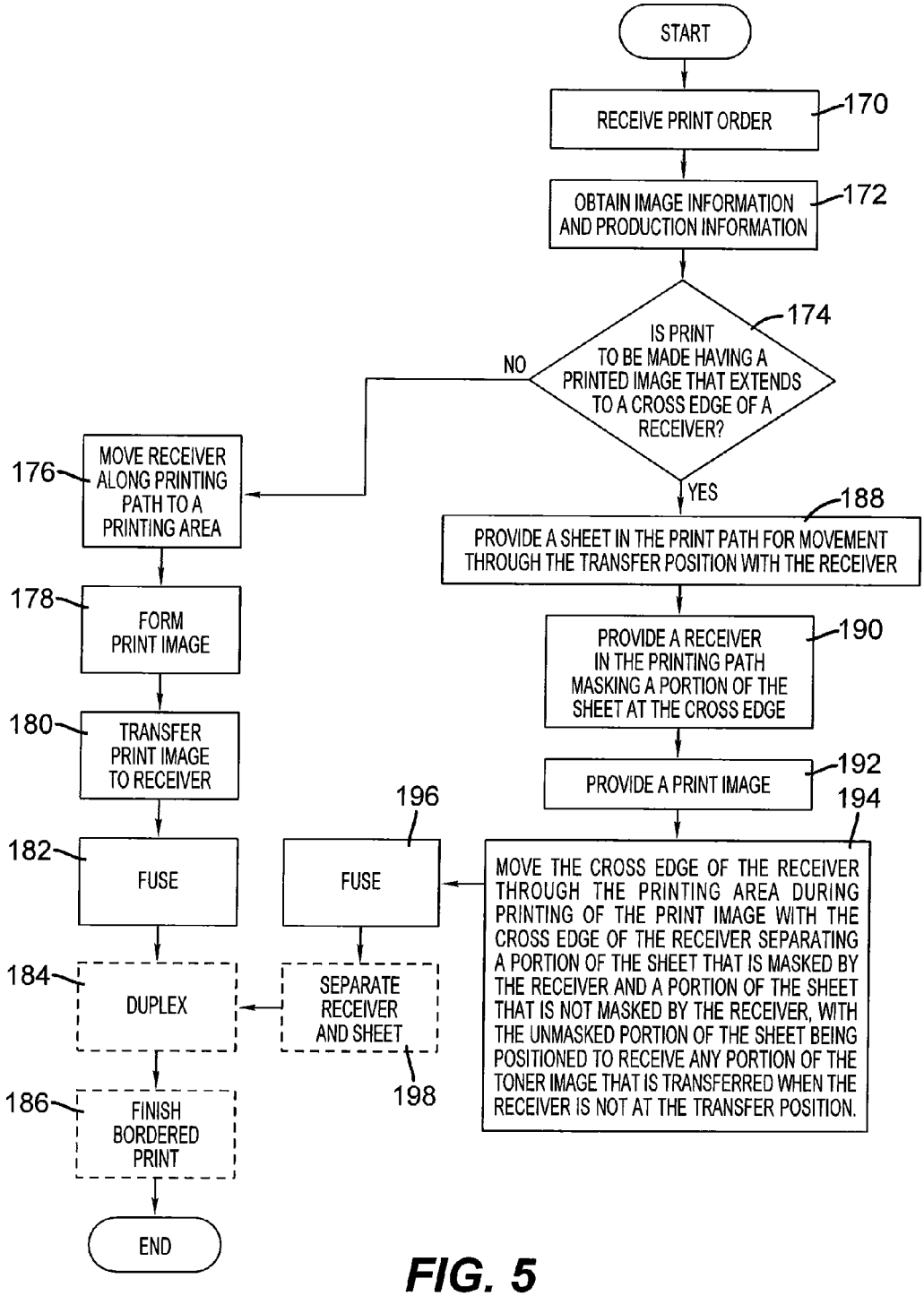
FIG. 5 shows a flow chart of a first embodiment of a method for using a printer to form a borderless print.

As is shown in the embodiment of FIGS. 3, 4 and 5 printing module 40 can optionally use a local controller 83. Local controller 83 can comprise any control circuit or system including but not limited to a microprocessor, microcontroller and hardwired control circuits (not shown). Local controller 83 can directly controller printing module 40 in response to general instructions from printer controller 82. In other embodiments, local controller 82 can offer assistance to printer controller 82 in controlling printing module 40. In the following sections, reference will be made to particular steps or actions being made or performed by printer controller 82. Unless otherwise specified herein any steps described as being performed by printer controller 82 can also be performed in alternative embodiments by printer controller 82 in cooperation with local controller 83 or by local controller 83.

Primary imaging system 110 includes a primary imaging member 112. In the embodiment of FIGS. 2, 3 and 4, primary imaging member 112 takes the form of an imaging cylinder. However, in other embodiments primary imaging member 112 can take other forms, such as a belt or plate. As is indicated by arrow 109 in FIGS. 2, 3, and 4, primary imaging member 112 is rotated by a motor (not shown) such that primary imaging member 112 rotates from charging subsystem 120, to writing subsystem 130 to first development station 140 and past a transfer nip 156 with a transfer system 50, past a cleaning subsystem 158 and back to charging subsystem 120.

In the embodiment of FIGS. 2, 3, and 4, primary imaging member 112 has a photoreceptor 114. Photoreceptor 114 includes a photoconductive layer formed on an electrically conductive substrate. The photoconductive layer is an insulator in the substantial absence of light so that initial differences of potential Vi can be retained on its surface. Upon exposure to light, the charge of the photoreceptor in the exposed area is dissipated in whole or in part as a function of the amount of the exposure. In various embodiments, photoreceptor 114 is part of, or disposed over, the surface of primary imaging member 112. Photoreceptor layers can include a homogeneous layer of a single material such as vitreous selenium or a composite layer containing a photoconductor and another material. Photoreceptor layers can also contain multiple layers.

Charging subsystem 120 is configured as is known in the art, to apply charge to photoreceptor 114. The charge applied by charging subsystem 120 creates a generally uniform initial difference of potential relative to ground on photoreceptor 114. In this embodiment, an optional meter 128 is provided that measures the electrostatic charge on photoreceptor 114 after initial charging and that provides feedback to, in this example, printer controller 82, allowing printer controller 82 to send signals to adjust settings of the charging subsystem 120 to help charging subsystem 120 to operate in a manner that creates a desired initial difference of potential on photoreceptor 114. In other embodiments, a local controller or analog feedback circuit or the like can be used for this purpose.

Writing subsystem 130 is provided having a writer 132 that forms charge patterns on a primary imaging member 112. In this embodiment, this is done by exposing primary imaging member 112 to electromagnetic or other radiation that is modulated according to image data provided for printing module 48. The modulation of electromagnetic or other radiation causes primary imaging member 112 to have image modulated charge patterns thereon. The image data provided for printing module 48 defines the pattern of toner 24 in printing module 48 that is to be applied to a particular image. The image data provided for printing module 40 can include, for example and without limitation, color separation image data to form a latent electrostatic image (e.g., of a color separation corresponding to the color of toner deposited at printing module 48).

In the embodiment shown in FIGS. 2, 3, and 4, writing system 130 exposes uniformly-charged photoreceptor 114 of primary imaging member 112 to actinic radiation provided by selectively activating particular light sources in a Light Emitting Diode (LED) array. In embodiments using an LED array, the array can include a plurality of LEDs arranged next to each other in a line, all dot sites in one row of dot sites on the photoreceptor can be selectively exposed simultaneously, and the intensity or duty cycle of each LED can be varied within a line exposure time to expose each dot site in the row during that line exposure time. In other embodiments, a laser device can be directed to form a pattern of light on photoreceptor 114. In embodiments using laser devices, a rotating polygon (not shown) or other movable reflector is used to scan one or more laser beam(s) across the photoreceptor in the fast-scan direction. One dot site is exposed at a time, and the intensity or duty cycle of the laser beam is varied at each dot site.

Various embodiments described herein describe the formation of an imagewise modulated charge pattern on a primary imaging member 112 by using a photoreceptor 114 and optical type writing subsystem 130. Such embodiments are exemplary and any other system, method, or apparatus known in the art for forming an imagewise modulated pattern of differences of potential on a primary imaging member 112 consistent with what is described or claimed herein can be used for this purpose.

As used herein, an "engine pixel" is the smallest addressable unit of primary imaging system 110 or in this embodiment on photoreceptor 114 which writer 132 (e.g., a light source, laser or LED) can expose with a selected exposure different from the exposure of another engine pixel. Engine pixels can be at separate locations on the primary imaging member 112 or alternatively the engine pixels can overlap, e.g., to increase addressability in a slow scan direction. Each engine pixel has a corresponding engine pixel location on an image and the writing exposure applied to the engine pixel location is described by an engine pixel level. The engine pixel level is determined based upon the density of the color separation image being printed by printing module 40.

After writing, primary imaging member 112 has an image modulated difference of potential at each engine pixel location that varies between a higher difference potential that can be at an initial difference of potential reflecting in this embodiment, a difference of potential at an engine pixel location that has not been exposed, and that can be above a lower level reflecting in this embodiment a lower difference of potential at an engine pixel location that has been exposed by an exposure at an upper range of available exposure settings.

Another meter 134 is optionally provided in this embodiment and measures charge within a non-image test patch area of photoreceptor 114 after the photoreceptor 114 has been exposed to writer 132 to provide feedback related to differences of potential created using writer 132 and photoreceptor 114. Other meters and components (not shown) can be included to monitor and provide feedback regarding the operation of other systems described herein so that appropriate control can be provided.

Development station 140 has a toning shell 142 that provides a developer 148 having toner 24 and optionally a carrier (not shown) near primary imaging member 112. Toner 24 is charged and has the same polarity as the initial charge on primary imaging member 112 and as any image modulated potential of the engine pixel locations on primary imaging member 112. Development station 140 also has a supply system 146 for providing charged toner 24 proximate to toning shell 142 and a power supply 150 for providing a bias for toning shell 142. Supply system 146 can be of any design that maintains or that provides appropriate levels of a developer having a charged toner 24 at toning shell 142 during development. Developer 148 can be a one part developer having toner 24 or a two part developer having a toner 24 and carrier (not shown) as is known in the art). Similarly, power supply 150 can be of any design that can maintain the bias described herein. In the embodiment illustrated here, power supply 150 is shown optionally connected to printer controller 82 which can be used to control the operation of power supply 150.

The bias at toning shell 142 creates a development difference of potential VD1 of the first polarity relative to ground. The development difference of potential VD1 causes toner 24 to move from toning shell 142 to develop on individual engine pixel locations of primary imaging member 112 in amounts that are determined based upon the strength of the electrostatic field at the engine pixel location. The electrostatic forces that cause toner 24 to deposit onto primary imaging member 112 can include Coulombic forces between charged toner particles and the charged electrostatic latent image, and Lorentz forces on the charged toner particles due to the electric field produced by the bias voltages.

In various embodiments, development can be performed using a Discharge Area Development (DAD) model, where the amount of toner that develops at an engine pixel location and monotonically increases with an extent to which the electrostatic charge at an engine pixel location is discharged from an initially charged state, or a Charge Area Development (DAD) model where the amount of toner that develops at an engine pixel location increases monotonically with an amount of charge developed from an initially discharged state and the writing strategy used in forming the electrostatic image will conform to the type of development model used. It will be appreciated from this that selection of the DAD or CAD writing model will influence the design and implementation of various components printing module 40 including, but not limited to, primary imaging member 112, photoreceptor 114 and writing system 130.

Whichever development model is used, a resultant print image 25 is formed and as is shown in FIG. 3, rotation of primary imaging member 112 causes print image 25 to move through a transfer nip 156 between primary imaging member 112 and a transfer system 50. As shown in FIG. 3, in this embodiment transfer system 50 has an intermediate transfer member 162 taking the form of a roller that receives print image 25 at transfer nip 156.

As is shown in FIG. 4, movement of intermediate transfer member 162 causes surface 164 to move so that print image 25 passes to printing area 27 where print image 25 is transferred from transfer surface 164 of intermediate transfer member 162. In this embodiment, transfer system 50 includes transfer backup member 160 opposite transfer member 162 at printing area 27 and intermediate transfer member 162 optionally has a resilient support (not shown) for transfer surface 164. As is also shown in FIG. 4 movement of print image 25 through printing area 27 is accompanied by movement of receiver 26 through printing area 27 so that receiver 26 is generally aligned with print image 25. However, for reasons that will be discussed below, precise alignment of a cross edge of print image 25 and a cross edge of a receiver is not critical. As is further shown in the embodiments of FIGS. 2, 3 and 4 a transfer power supply 168 is provided to create a transfer field between intermediate transfer member 162 and transfer backup member 160 to facilitate the transfer of print image 25 onto receiver 26.

In printing module 40, the time at which a print image 25 passes through a printing area 27 is determined principally by a time at which writing of a latent electrostatic image that will be developed to form print image 25 begins, a time required to develop and to transfer a print image 25 onto transfer surface 164 and a time required for the transfer surface 164 to move print image 25 to printing area 27.

In this regard, in a conventional mode of operation, a printer controller 82 causes writing subsystem 130 to form a latent electrostatic image that will be developed to form print image 25 on primary imaging member 112 so that a first cross edge 25A of print image 25 is positioned on primary imaging member 112 at a time that is calculated so that the arrival of first cross edge 25A of print image 25 will occur after first cross edge 26A of receiver 26 has reached printing area 27. Similarly, the writing of print image 25 is timed so that a second cross edge 25B of print image 25 passes through printing area 27 at a time that is calculated so that the arrival of second cross edge 25B of print image 25 at printing area 27 will occur before the arrival of second cross edge 26B of receiver 26 at printing area 27. This yields a bordered print, but prevents the risks associated with transferring print image 25 when receiver 26 is not positioned in the printing area 27. As is noted above, there are a number of factors that can cause a print image such as print image 25 and a receiver 26 to be misaligned as they enter a printing area 27. Therefore there may be a misalignment of first cross edge 25A and second cross edge 25B of print image 25 with either or both of first cross edge 26A and second cross edge 26B.

In the embodiment of FIGS. 2, 3 and 4, printer controller 82 determines when receiver 26 has been moved to a predetermined position by receiver transport system 28 and then determines when to form the latent electrostatic image that is to be developed to form print image 25 by predicting when first cross edge 26A of receiver 26 will enter printing area 27 and by causing writing system 130 to generate the latent electrostatic image so that first cross edge 25A of print image 25 is formed on primary imaging member 112 at a time that will position first cross edge 25A of print image 25 so that print image 25 is transferred onto a transfer surface in transfer system 50 at a position that will be moved to printing area 27 in concert with first cross edge 26A of receiver 26.

In FIGS. 2, 3, and 4 a proximity sensor 54 is positioned along printing path 31 to sense one or more conditions that are indicative of the presence of first cross edge 26A of receiver 26 at a first position 56 along printing path 31. When one or more of the conditions are sensed a presence signal is sent to printer controller 82. Printer controller 82 uses the presence signal to determine when to cause an electrostatic image to be formed on primary imaging member 112 so that a print image 25 developed using the electrostatic image formed on primary imaging member 112 will be transferred to transfer surface 164 to cause print image 25 to be moved through toner printing area 27 within border areas of receiver 26. In one embodiment, proximity sensor 54 can separately sense a cross edge of the sheet and a cross edge of a receiver on the sheet and can determine the positioning of the print image based upon a time at which the cross edge of the receiver is at the proximity sensor and a time at which the cross edge of the receiver on the sheet reaches the proximity sensor.

In an alternative embodiment, the position at which writing system 130 will position a latent image giving rise to print image 25 is predetermined and for image quality reasons, for example, is performed at a preferred rate. Accordingly, in such a system, a predicted time at which first cross edge 25A and second cross edge 25B will be positioned at printing area 27 can be determined by printer controller 82. Printer controller 82 can compare this predicted time with the time at which the signal from proximity sensor 54 is received in order to determine when first cross edge 26A of receiver 26 reaches first position 56 and adjusts the rate at which receiver 26 is moved from first position 56 in an effort to cause first cross edge 25A and first cross edge 26A to enter printing area 27 in concert.

A verification sensor 59 is also provided in the embodiment of FIGS. 2, 3, and 4. Verification sensor 59 is provided to detect when surface 30 transports more than one receiver 26 in an overlapped or stacked configuration. In conventional printing operations, such a stacked configuration can cause prints to be formed having unintended artifacts. Accordingly, when operated in to make a conventional print, printer controller 82 can use signals from the verification sensor 59 to detect such conditions and to interrupt printing to prevent such artifacts. In another embodiment, verification sensor 59 can separately sense a cross edge of the sheet and a cross edge of a receiver 26 on sheet 80 and can determine the positioning of print image 25 based upon a time at which a cross edge of receiver 26 is sensed by verification sensor 59 and a time at which the cross edge of a sheet 80 (FIG. 6) is sensed by the verification sensor 59.

As is shown in FIGS. 2, 3 and 4, printing module 40 can be locally controlled by a local controller 83 and provided as a stand alone printing module such that local controller 83 can receive signals from printer controller 82 or directly from and can make determinations about when to form a print image 25 based upon such signals. Either printer controller 82 or local controller 83 determines that a print is to be made having an image that extends to a cross edge of the receiver local controller can determine any adjustments based upon such a determination.

However, as is noted above, there are many factors that can prevent such alignment systems from achieving alignment of either first cross edge 25A with first cross edge 26A or alignment of second cross edge 25B with second cross edge 26B.

FIG. 5 shows a flowchart depicting a first embodiment of a method for operating a printer 20 to generate a print having an image that extends to a cross edge such as first cross edge 26A or second cross edge 26B of receiver 26 without requiring precise alignment of a toner image with a receiver and without requiring cutting of across a width of a travel path along which a receiver is moved in order to create a cross-edge edge having an image that extends to the cross-edge.

The embodiment of FIG. 5 begins when a print order is received (step 170) and printer controller 82 uses the print order to obtain image information and production information (step 172). The image information can include any type of information that can be used by printer controller 82 or any other component of printer 20 to obtain, recreate, generate or otherwise determine image information for use in printing and the image information can comprise any type of information that can be used to form any pattern that can be made using one or more applications of toner. The production information can include printing information that indicates how the image information is to be printed and, optionally, finishing information that defines how the print is to be finished, and can include information for cutting, binding, glossing, sorting, stacking, collating, and otherwise making use of a print that is made according to the image information and printing information.

In one example, the print order includes image information in the form of image data such as an image data file that printer controller 82 can use for printing and also contains production information that provides printing instructions that printer controller 82 can use to determine how this image is to be formed on a receiver 26. In another example, the print order can comprise image information in the form of instructions or data that will allow printer controller 82 and communication system 90 to obtain an image data file from one or more external devices 92. In another example, a print order can contain image information in the form of data from which printer controller 82 can generate the determined image for example from an algorithm or other mathematical or other formula. In another example, the image information can include image data from separate data files and/or separate locations, and/or other types of image information. These examples are not limiting and a print order can be received and image information and production information can be obtained using the print order in any other known manner.

It is then determined whether the print order requires printing of an image that extends to a cross edge of a receiver 26 (step 174). In certain embodiments, a print order will have printing instructions that indicate that a print 70 is to be made having a print image 25 that extends to a cross edge of a receiver 26. For example, the print order can include information from which printer controller 82 can determine image data to be used in printing and printing instructions including an instruction to print the image data in a manner that causes toner image to be transferred along a cross edge of a receiver.

Alternatively, a print order can have production information including printing instructions that define a shape and size of a receiver 26 to be used in printing and can have image information that includes data that determines or that can be used to determine a size, shape, and position of a print image 25 that is to be formed on receiver 26. Printer controller 82 can be used identify situations where a print image 25 is to extend to a cross edge of receiver 26.

In other non-limiting alternative embodiments, a print order can be received in a form that does not inherently indicate that a print image 25 is to be printed in a manner that extends to a cross edge of receiver 26 and, in such an embodiment a user can undertake a user input action that can be sensed by user input system 84 and that can be used by printer controller 82 to determine that the print order is to be made in a fashion that involves printing a print image 25 that extends along a cross edge of receiver 26. In one example, a user may make a user input action that can be sensed by user input system 84 and interpreted by printer controller 82 as an instruction that a print 70 is to be made having an image that extends to at least one edge of print 70. This selection can be sensed, for example, by a dedicated switch that is part of user input system 84 or sensed by way of a text input or an input made by way of an interaction with a graphical user-interface. This is not limiting and any other type of user input system 84 can be used in printer 20 to sense a user input action that printer controller 82 can determine indicates that a print is to be made having a print image 25 that extends along a cross edge of receiver 26.

Printer controller 82 can make this determination in other ways. For example, this a determination can be made based upon analysis of the print order including production data or other types of data or instructions from which it can be calculated or otherwise automatically determined that print image 25 is to extend to a cross edge of receiver 26. Alternatively, printer controller 82 can make this determination based upon data indicating a location from which such data can be obtained by printer controller 82 such as by way of communication system 90. In certain embodiments the print order data can include information that identifies a mounting onto which the image is to be placed. This can include for example a frame, pocket, pouch or other surface that is associated with a defined area for housing or mounting a receiver having a certain length. The mounting itself may mask the cross edges in which case it is not necessary to extend an image to a cross edge.

Printer controller 82 can make this determination by way of any other type of analysis known in the printing arts that can be used to determine that a print order requires that a print image 25 be printed along an edge of receiver 26.

Printer controller 82 can perform the analysis necessary to make a determination as to whether a print image 25 is to extend to cross edge of a receiver 26 such as first cross edge 26A or second cross edge 26B by reference to a look up tables or databases that can be stored in memory 88 or that are available by way of communication system 90, by use of programmatic algorithms, such as computer code and the like and by use of any other mathematical, logical, geometric or other method that can receive information that can be obtained in any way using a print order, or a user input action, or a determined output type and can automatically determine that a print order indicates that an image is to be printed that extends to a cross edge of a receiver.

Where printer controller 82 determines that the print order does not require forming a print image 25 that extends to a cross edge of receiver 26 (step 174) printer controller 82 can use conventional processes to form a bordered print. In this regard, printer controller 82 can use conventional processes to provide a receiver 26 and to move receiver 26 along a printing path 31 for transfer (step 176). For example, as is shown in the embodiment of FIG. 1, printer controller 82 causes receiver delivery system 32 to supply a receiver 26 to movable surface 30.

In the embodiment of FIG. 1, a receiver delivery system 32 has a receiver delivery apparatus 34 and an actuator system 37 that cooperates with receiver delivery apparatus 34 to allow or to enable receiver 26 to move from a receiver supply 35 to a position where movable surface 30 can move receiver 26 along printing path 31 to print engine 22. Here, receiver delivery apparatus 34 is generally illustrated as being movable between a position where a receiver 26 cannot travel to movable surface 30 and a position where receiver 26 will be guided by the receiver delivery apparatus 34 to movable surface 30. Receiver delivery apparatus 34 is moved between these positions by actuator system 37 which can comprise a motor, solenoid or any other type of system that can cause movement of receiver delivery apparatus 34. In other embodiments, any other type of receiver delivery system 32 can be used that will allow printer controller 82 to cause a receiver 26 to be located on a movable surface 30 of a receiver transport system 28 as described herein.

Receiver 26 is then moved by movable surface 30 to print engine 22 where receiver 26 can be positioned so that toner image can 25 can be transferred onto receiver 26. The embodiment of printer 20 shown in FIG. 1 further includes a sheet delivery system 72. However, sheet delivery system 72 is not used where printer controller 82 has determined that a print 70 does not have a printed image that extends to a cross edge of receiver 26.

At least one print image 25 is then generated based upon the image information and production information (step 178). The print image 25 is then transferred onto receiver 26 (step 180) and is fused to receiver 26 (step 182). These steps can be performed conventionally. Thereafter, duplex printing can optionally be performed on receiver 26 (step 184) and receiver 26 optionally can be subject to any finishing indicated by the production information (step 186). Such finishing can be performed by finishing system 100.

However, where printer controller 82 determines that a print 70 is to be made having an image that extends to a cross edge such as first cross edge 26A or a second cross edge 26B of receiver 26 (step 174) printer controller 82 causes a sheet 80 to be introduced into printing path 31 for movement along printing path 31 (step 188) and then causes a receiver 26 to be positioned on sheet 80 (step 190).

Figure 6:
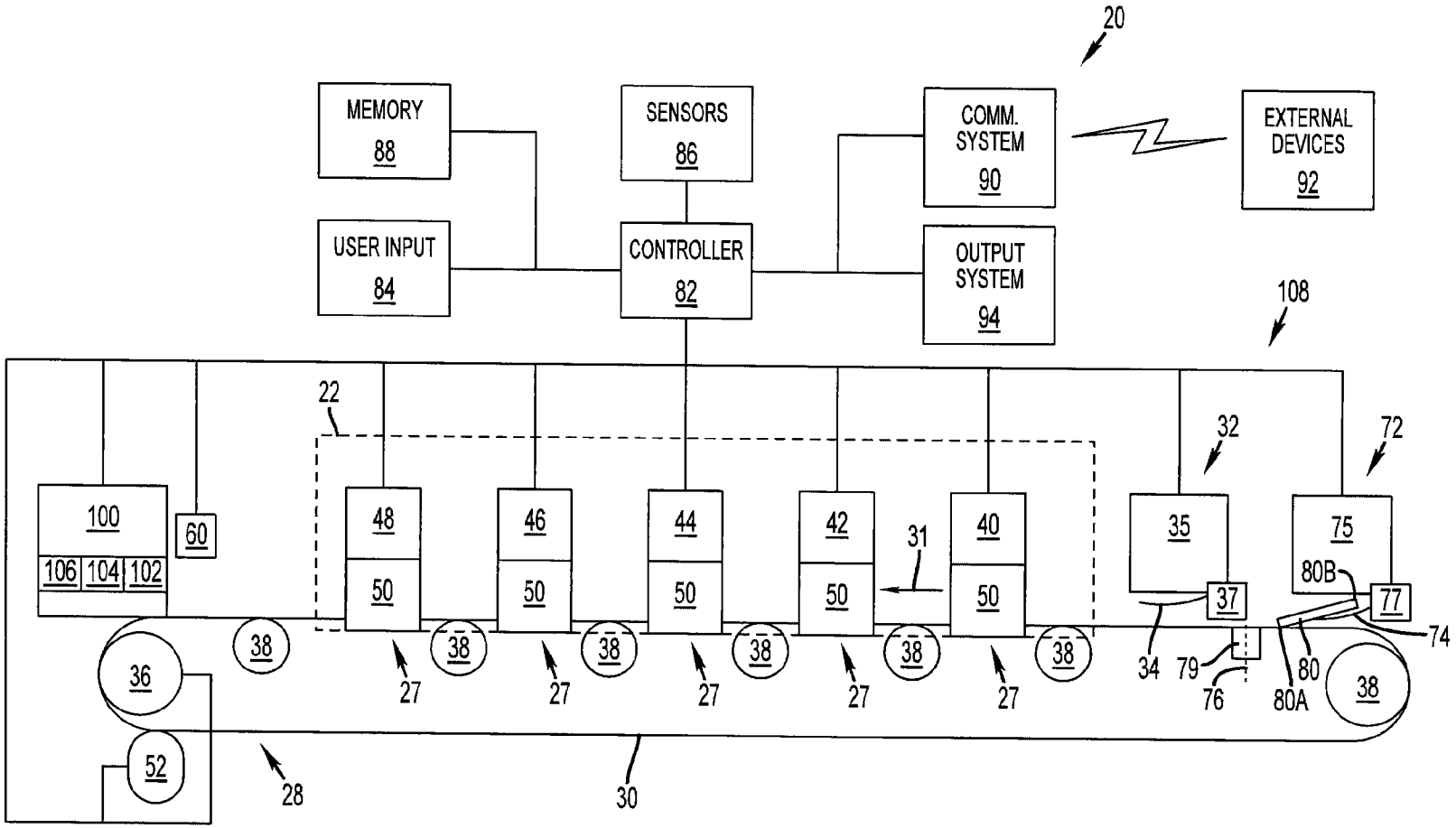
FIG. 6 shows the printer of FIG. 1 with an overlap positioning system providing a sheet in a printing path.
Figure 7:
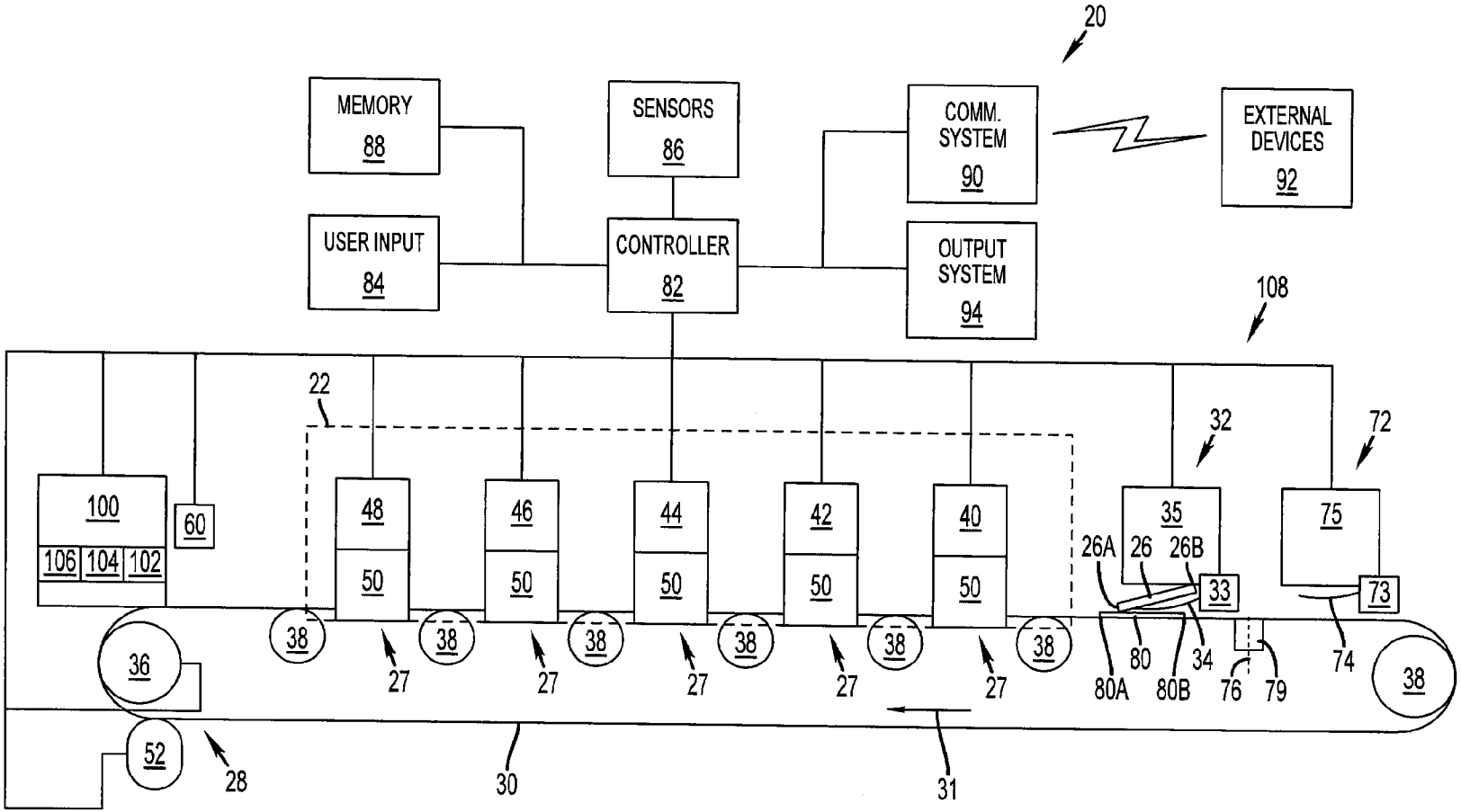
FIG. 7 shows the printer of FIGS. 1 and 6 with a receiver being positioned on the sheet.

FIGS. 6 and 7 depict printer 20 of FIG. 1 being used in the process of forming a print having an image that extends to a cross edge of the print according to one embodiment of the method of FIG. 5. As is shown in FIGS. 6 and 7, an overlap positioning system 108 is used to provide receiver 26 on sheet 80 along printing path 31. In the embodiment of FIGS. 6 and 7, overlap positioning system 108 comprises receiver transport system 28, receiver delivery system 32 and sheet delivery system 72.

In operation, printer controller provides a sheet 80 in printing path 31 before receiver 26 is positioned in printing path 31. Accordingly, as is shown in FIG. 6 where printer controller 82 determines that a print is to be made having a print image 25 that extends to at least one cross edge of a receiver 26 (step 174), printer controller 82 causes sheet delivery system 72 to provide a sheet 80 on movable surface 30 of receiver transport system 28 for movement along printing path 31 (step 170).

In this embodiment, sheet delivery system 72 has a sheet delivery apparatus 74 between a sheet supply 75 and movable surface 30 and an actuator system 77. Here, sheet delivery apparatus 74 is generally illustrated as being movable between a position where a receiver 26 cannot travel to movable surface 30 and a position where sheet 80 will be guided by sheet delivery apparatus 74 to movable surface 30. Receiver delivery apparatus 34 is moved between these positions by actuator system 77 which can comprise a motor, solenoid or any other type of system that can cause movement of receiver delivery apparatus 34. To cause a sheet 80 to be placed on movable surface 30, printer controller 82 causes actuator system 77 and sheet delivery apparatus 74 to cooperate so that a sheet 80 is moved from sheet supply 75 to a position at which movable surface 30 can move sheet 80 along printing path 31.

In this embodiment, a sheet presence sensor 79 detects conditions that indicate that a first cross edge 80A of sheet 80 is at a predetermined position 76 and in response can generate a sheet presence signal. Sheet presence sensor 79 can comprise any known form of optical, mechanical, electrical, or other sensor that can sense any condition from printer controller 82 can make this determination.

Printer controller 82 causes actuator system 37 and receiver delivery apparatus 34 to cause receiver 26 to be positioned on sheet 80 as sheet 80 is moved past receiver delivery system 32 (step 172). This places receiver 26 between sheet 80 and print engine 22 during printing so that receiver 26 masks sheet 80 when receiver 26 and sheet 80 are moved through one or more transfer areas 27 in printing modules 40, 42, 44, 46, and 48. Printer controller 82 determines the relative location of receiver 26 and sheet 80 based upon when the signal from the sheet presence sensor 79 indicates that sheet 80 has reached the predetermined position.

As is shown in FIG. 7, printer controller 82 causes receiver 26 to mask sheet 80 at any cross edge of receiver 26 to which an image is to extend. In the example that is shown in FIG. 7, printer controller 82 has determined that an image is to extend to both first cross edge 26A and to second cross edge 26B of receiver 26. Accordingly, as is shown in FIG. 7, printer controller 82 causes receiver 26 to be positioned to mask sheet 80 at both first cross edge 26A and at second cross edge 26B.

Figure 8:
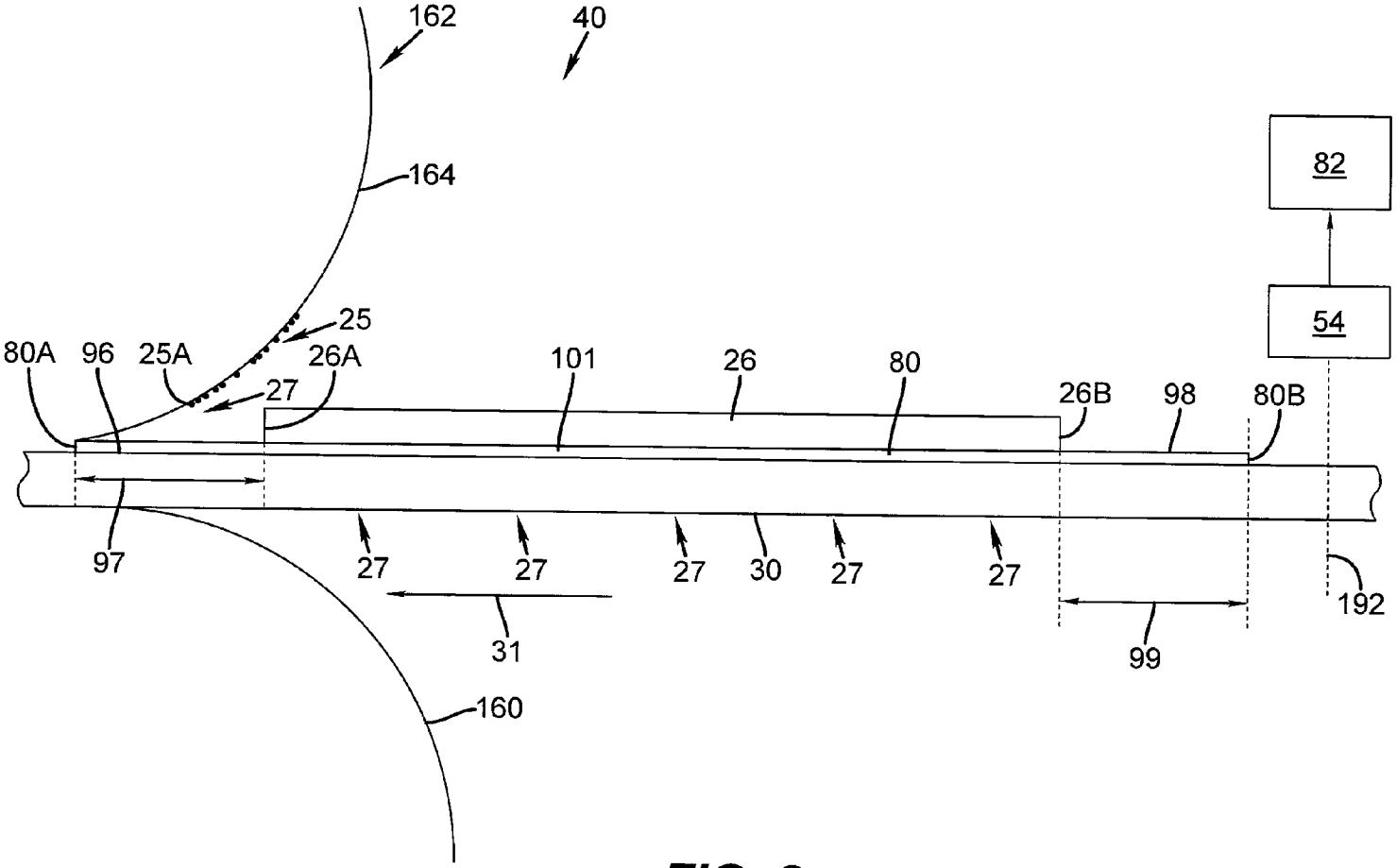
FIG. 8 shows the receiver and sheet positioned as shown in FIG. 7 prior to entry into a printing area.

FIG. 8 illustrates, in greater detail, receiver 26 and sheet 80 positioned as described with reference to FIG. 7 and moved by movable surface 30 to a location just before receiver 26 and sheet 80 are moved into a printing area 27 in printing module 40. As is shown in FIG. 8 first cross edge 26A of receiver 26 is positioned on sheet 80 separated from first cross edge 80A of sheet 80 to separate a first unmasked portion 96 of sheet 80 having a first length 97 from a masked portion 101 of sheet 80 that receiver 26 masks from toner transfer. Accordingly, first cross edge 80A will enter a printing area 27 of printing module 40 before first cross edge 26A of receiver 26 enters printing area 27.

Similarly, second cross edge 26B of receiver 26 is positioned on sheet 80 and separated from second cross edge 8013 of sheet 80 by a second length 99 and separates a second unmasked portion 98 of sheet 80 from masked portion 101. Positioned in this manner, second cross edge 80B of sheet 80 will enter printing area 27 after second cross edge 26B of receiver 26 enters printing area 27.

A print image is then provided (step 192) for receiver 26. In the embodiment of FIG. 8, the print image comprises a print image 25 that is formed on a primary imaging member 112 when printer controller 82 receives the proximity signal from proximity sensor 54, printer controller 82 determines a time at which to cause writing system 130 to begin forming the electrostatic latent image that will cause print image 25 to be formed. In particular, printer controller 82 uses the proximity signal from proximity sensor 54 to determine where to position a print image 25 so that it is assured that first cross edge 25A of print image 25 enters toner printing area 27 at or before first cross edge 26A of receiver 26 enters toner printing area 27 regardless of any of the factors that can cause variations in the relative position of print image 25 and receiver 26.

As is noted above, with reference to FIGS. 2, 3, and 4 verification sensor 59 can detect when more than one receiver 26 is stacked on surface 30 and, in conventional modes of operation, can declare an error when this occurs. However, when printer controller 82 determines that printing is to extend to a cross edge of a receiver 26, printer controller 82 can use a signal from the verification sensor 59 indicating that the presence of stacked substrates such as receiver 26 and sheet 80 on moving surface 30 to determine that image printing will be made onto a receiver 26 that overlaps a sheet 80.

In this regard, printer controller 82 can use any of a variety of processes to determine where to position a print image 25 so that print image 25 will be formed on a portion of a primary imaging member 112 that will cause print image 25 to transfer onto transfer surface 164 so that print image 25 will reach printing area 27 at a time where receiver 26 is positioned to receive print image 25. Generally speaking, this determination can be made in the same manner that such a determination is made for a conventional bordered print as is described above.

Optionally, an adjustment of the positioning can be provided in order to ensure that first cross edge 25A of print image 25 reaches printing area 27 at or before first cross edge 26A of receiver does so. The adjustment can be a constant value, one of a set of different adjustments that can be selected for example using a look up table, or a value that is calculated or determined using an algorithm. The extent of the adjustment can be determined experimentally or it can be calculated based upon known mechanical and material properties of the printer, the receiver, or the toner and can vary based upon sensed conditions in the printer 20.

In one embodiment, the extent of the adjustment can be made based the separation between opposing cross edges of either receiver 26 or sheet 80 that can be determined for example based upon signals from proximity sensor 54. That is a distance between a first cross edge 26A and a second cross edge 26B of a receiver or a first cross edge 80A and a second cross edge 80B may be indicative of a length of a receiver 26 or sheet 80 and this length may be useful in determining the extent of an adjustment where, as here, there is a desire to cause print image 25 to extend both to first cross edge 26A and second cross edge 26B.

Additional factors that can influence the extent of an adjustment include factors that can create variability in the time at which a latent electrostatic image is to be formed, and factors that can influence the variability in the development or transfer of a toner image. In one embodiment, such potential sources of variability can be stacked up to determine a worst case scenario that characterizes a greatest range of potential variability between print image 25 and receiver 26.

Figure 9:
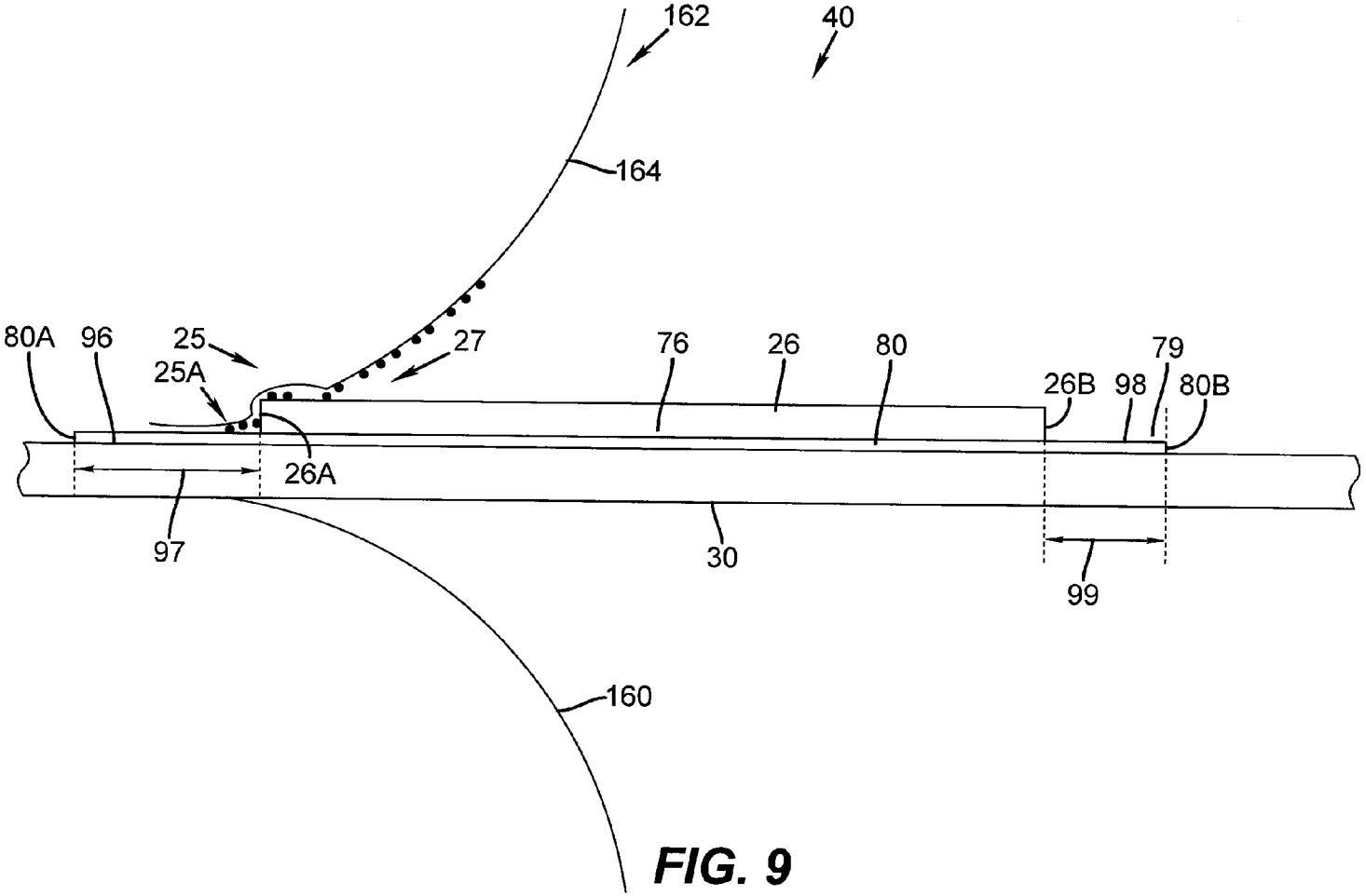
FIG. 9 shows the receiver and sheet positioned as shown in FIGS. 7 and 8 with a first cross edge of the receiver and a first cross edge of the sheet positioned in a printing area during a transfer of toner from a toner image.

Printer controller 82 then causes each cross edge of receiver 26 to move through the printing area 27 during the transfer of the print image 25 (step 194). As is illustrated in FIG. 9, printer controller 82 has caused print image 25 to be written at a time that causes first cross edge 25A of print image 25 to arrive at printing area 27 before first cross edge 26A of receiver 26 arrives at printing area 27. As is shown in FIG. 9, this ensures that toner from print image 25 is being transferred as first cross edge 26A of receiver 26 reaches printing area 27. This eliminates the risk that an unprinted border will exist at first cross edge 26A. Conversely, this also creates a possibility that print image 25 will reach printing area 27 before first cross edge 26A reaches printing area 27.

However, as is also is illustrated in FIG. 9, first unmasked portion 96 of sheet 80 is positioned to receive any portions of print image 25 that are transferred before first cross edge 26A of receiver 26 reaches printing area 27 while receiver 26 masks other portions of sheet 80 (step 194).

Accordingly, any portion of print image 25 that is proximate to a first cross edge 25A and that is transferred before receiver 26 is positioned in printing area 27 does not provide toner or other materials that contaminate movable surface 30 or escape into other portions of printer 20. Instead, such portions of print image 25 remain on sheet 80 and can be fused thereto (step 196). Importantly, because such portions of print image 25 are on sheet 80, and not on a portion of receiver 26, it is not necessary to cross cut receiver 26 proximate to first cross edge 26A in order to provide borderless printing along first cross edge 26A. Instead, all that is required is separation of sheet 80 and receiver 26 (step 198). This can be accomplished in any known manner. For example, simple stacking of the sheets will cause such separation in some embodiments, while in other embodiments, some of which are described below in greater detail, a diverter can be used to separate receiver 26 from sheet 82.

Advantageously, this approach provides a printer 20 and a method for operating a printer 20 that allows a print to be made having a printed image that extends to a first cross edge 26A of a receiver without requiring high precision alignment between a leading edge of the print image 25 and first cross edge 26A at the moment that transfer of print image 25 begins and without requiring cross cutting equipment and the cost, complexity processing delays associated with cross cutting operations.

Figure 10:
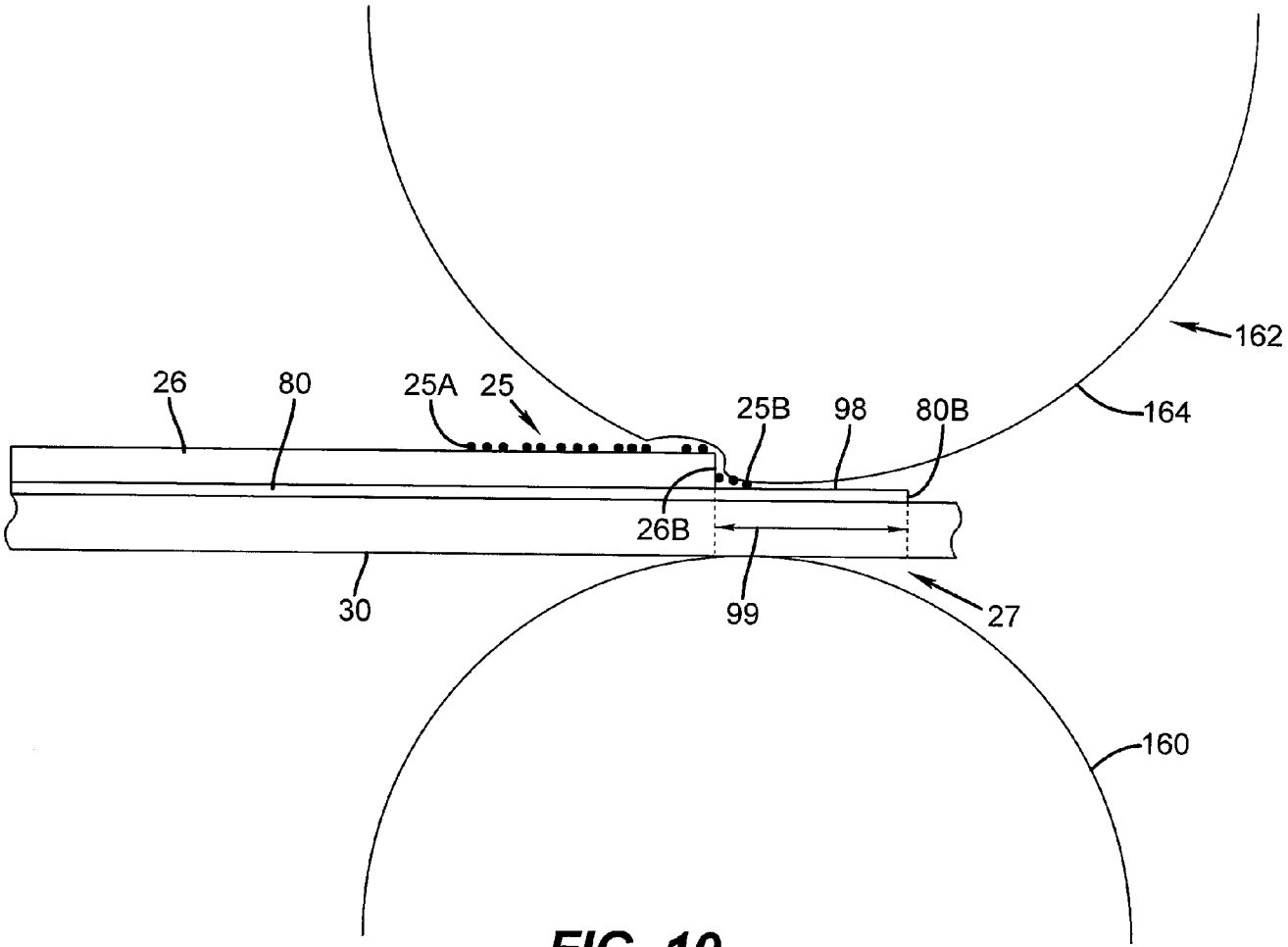
FIG. 10 shows the receiver and sheet positioned as shown in FIGS. 7, 8 and 9 with a second cross edge of the receiver and a second cross edge of the sheet positioned in the printing area during transfer of toner from a toner image.

As is shown in FIG. 10, similar results can be achieved when a print is to have an image that extends to a second cross edge 26B of receiver 26. Here, printer controller 82 causes print image 25 to be written at a time that will cause second cross edge 25B of print image 25 to arrive at printing area 27 before second cross edge 26B of receiver 26 arrives at printing area 27. This ensures that toner is being transferred as second cross edge 26B of receiver 26 reaches printing area 27 and eliminates the risk that an unprinted border will exist at second cross edge 26B. Conversely, this also creates a possibility that toner from print image 25 will transfer after second cross edge 26B reaches printing area 27.

However, as is also is illustrated in FIG. 10, sheet 80 and receiver 26 are positioned so that second unmasked portion 98 of sheet 80 is positioned to receive any portions a print image 25 that are transferred before first cross edge 26A of receiver 26 reaches printing area 27 while receiver 26 masks other portions of sheet 80 to receive print image 25. Here too, in one embodiment, the positioning of receiver 26 can be adapted to provide this outcome. This can be done as a part of determining an adjustment from a conventional alignment strategy as discussed above. In another approach, receiver 26 and sheet 80 are simply positioned at a distance that is judged or tested to extend beyond the extent of any potential misalignment.

Accordingly, any portion of print image 25 that is proximate to second cross edge 25B and that is transferred after receiver 26 is positioned in printing area 27 does not provide toner or other materials that contaminate movable surface 30 or escape into other portions of printer 20. Instead, such portions of print image 25 remain on sheet 80 and can be fused thereto (step 196). Importantly, because such portions of print image 25 are on sheet 80, and not on a portion of receiver 26, it is not necessary to cross cut receiver 26 proximate to second cross edge 26B in order to provide borderless printing along first cross edge 26B. Instead, all that is required is separation of sheet 80 and receiver 26 (step 198). This can be accomplished in any known manner. For example, simple stacking of the sheets will cause such separation in some embodiments, while in other embodiments, some of which are described below in greater detail, a diverter can be used to separate receiver 26 from sheet 82.

In embodiments such as those shown and described above with reference to FIGS. 1-10 where a print is to be formed having a printed image that extends from a first cross edge 26A of a receiver to a second cross edge 26B, a receiver 26 can be positioned with a first cross edge 26A and a second cross edge 26B between the first cross edge 80A and second cross edge 80B of a sheet 80. However, in other embodiments, receiver 26 can overlap and mask a sheet 80 at one cross edge of receiver 26.

After separation the receiver 26 optionally can be printed on an unprinted side to form a duplex print (step 184) and finished in any conventional way (step 186).

Overlap Positioning Systems

It will be appreciated that an overlap positioning system 108 can take a number of different forms and that there are a number of different ways in which a receiver 26 and a sheet 80 can be positioned relative to each other with receiver 26 positioned so that a cross edge of receiver 26 to which an image is to extend separates sheet 80 into at least one masked portion and one unmasked portion. The following figures illustrate and describe various examples of overlap positioning systems 108 that can be provided in conjunction with a receiver transport system 28 or elsewhere in printer 20 to position receiver 26 so that a cross edge of a receiver 26 overlaps a cross edge of a sheet 80.

Figure 11:
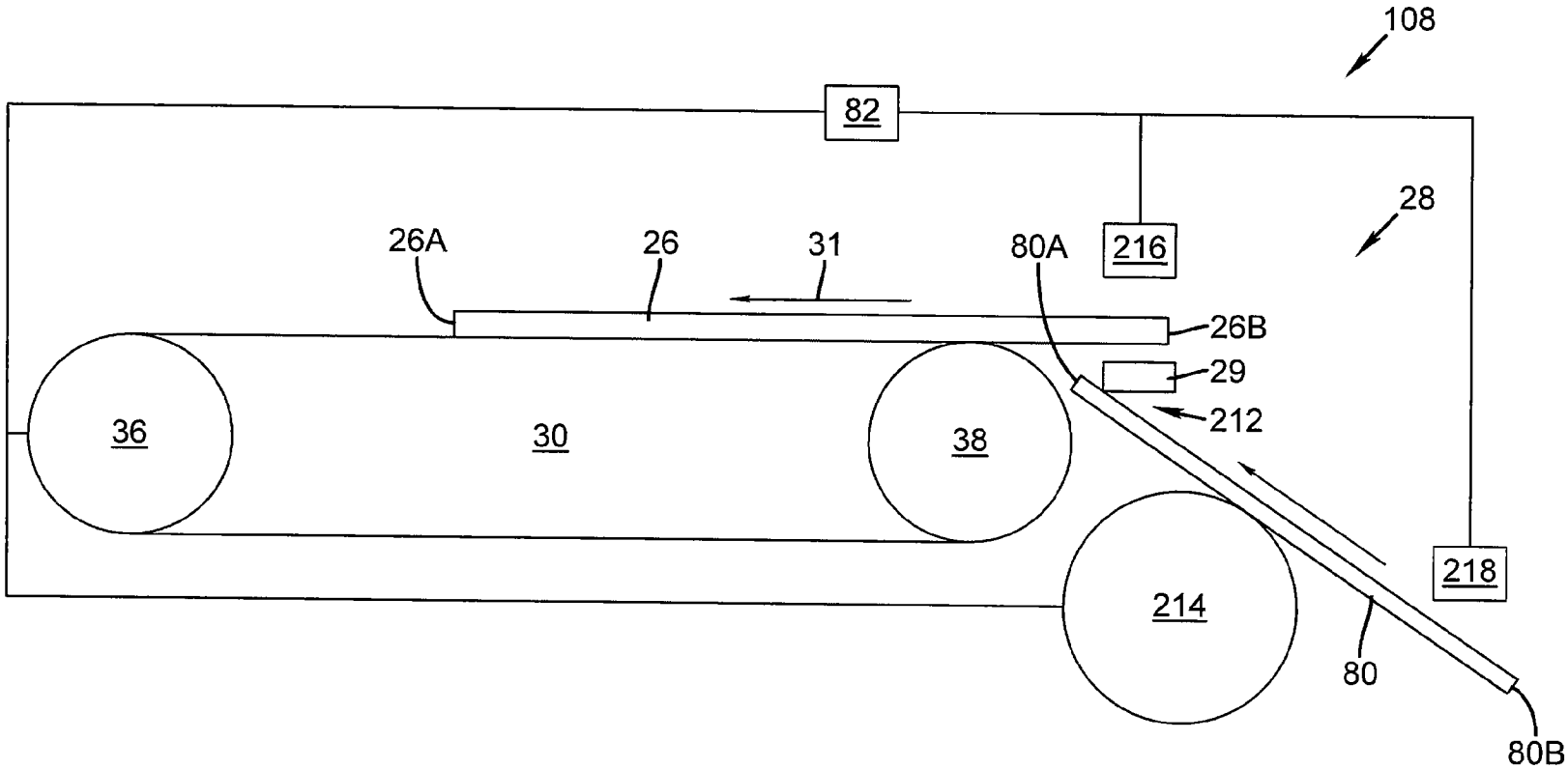
FIG. 11 shows another embodiment of an overlap positioning system used in conjunction with the method of FIG. 5 prior to overlap positioning.
Figure 12:
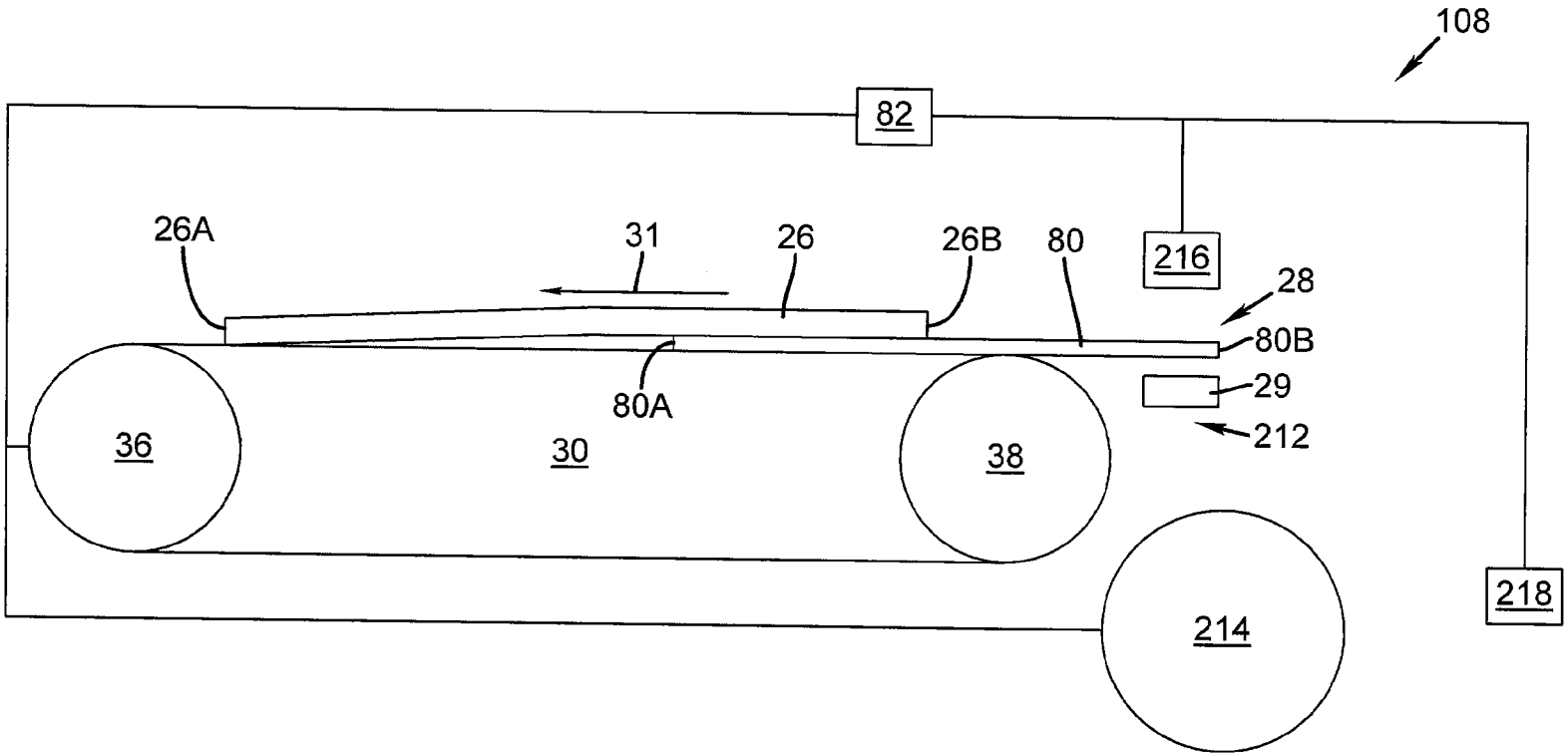
FIG. 12 shows the embodiment of FIG. 11 after overlap positioning has been performed.

As is shown in FIG. 11 receiver transport system 28 has an overlap positioning system 108 that can be used to provide a determined extent of overlap of a cross edge of a receiver 26 to which an image is to extend with a sheet 80. In this example, guides 29 or other combinations of surfaces direct receiver 26 as a motor 36 causes movable surface 30 position receiver 26 so that second cross edge 26B of receiver 26 is cantilevered away a curved length 212 of movable surface 30. Printer controller 82 then causes a sheet 80 to be advanced by a motorized drive roller 214 into a position where first cross edge 80A of sheet 80 is overlapped by a portion of receiver 26 ending at second cross edge 26B. A position sensing system 218 is positioned to detect when first cross edge 80A or as shown in FIG. 11, to detect when second cross edge 80B of sheet 80 is positioned where first cross edge 80A of sheet 80 is at a desired overlap with second cross edge 26B of sheet 80. When receiver 26 and sheet 80 are so positioned, position sensing system 218 sends signals to printer controller 82. Printer controller 82 can operate movable surface 30 and optionally motorized drive roller 214 to advance both sheet 80 and receiver 26 onto movable surface 30 as is shown in FIG. 12. Printer controller 82 can then motor 36 to advance sheet 80 and receiver 26 so that they travel along printing path 31 in the overlapped relation defined by overlap positioning system 108. An optional receiver sensing system 216 can also be provided to sense when second cross edge 26B is positioned at a desired position.

Figure 13:
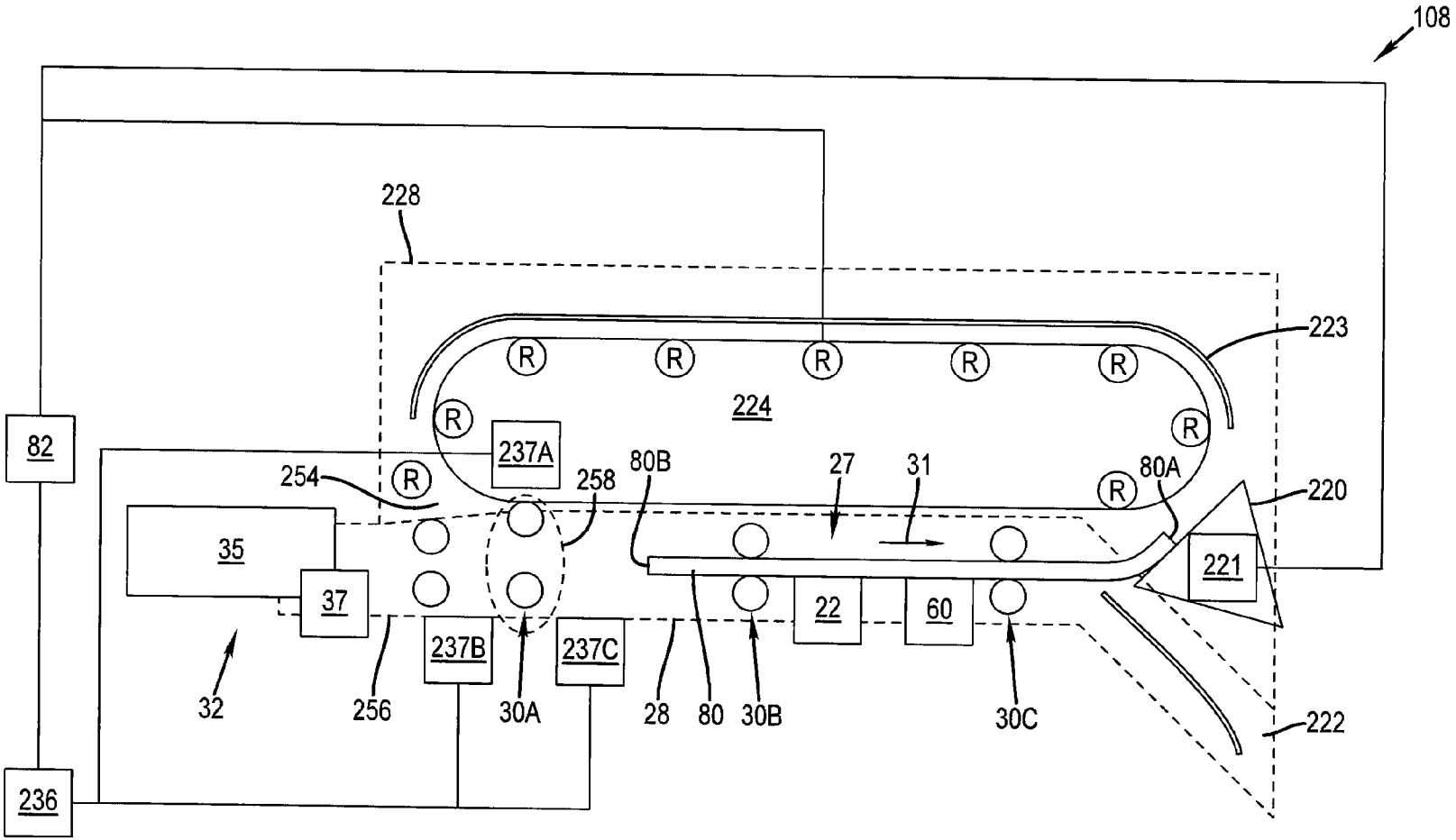
FIG. 13 shows another embodiment of an overlap positioning system used in conjunction with the method of FIG. 5 and having a recirculation system.

FIGS. 13, 14, 15, and 16 describe the operation of another embodiment of an overlap positioning system 108. In this embodiment, overlap positioning system 108 makes use of a recirculation system 228. As is shown in FIG. 13, in this embodiment, receiver delivery system 32 provides a sheet 80 that is passed through receiver transport system 28 past print engine 22 and fuser 60 to a diverter 220. Diverter 220 is positioned by an actuator 221 that causes diverter 220 to move in response to signals from printer controller 82. As is shown in FIG. 13, diverter 220 is located proximate to a post-printing path 222 of receiver transport system 28 and can be moved by an actuator 221 between a first position shown in FIG. 13, where diverter 220 engages a receiver 26 and/or sheet 80 to deflect the receiver 26 and/or sheet 80 for travel into recirculation system 228 and a second position (shown in phantom) where diverter 220 engages a receiver 26 and/or sheet 80 to travel along post-printing path 222.

Figure 14:
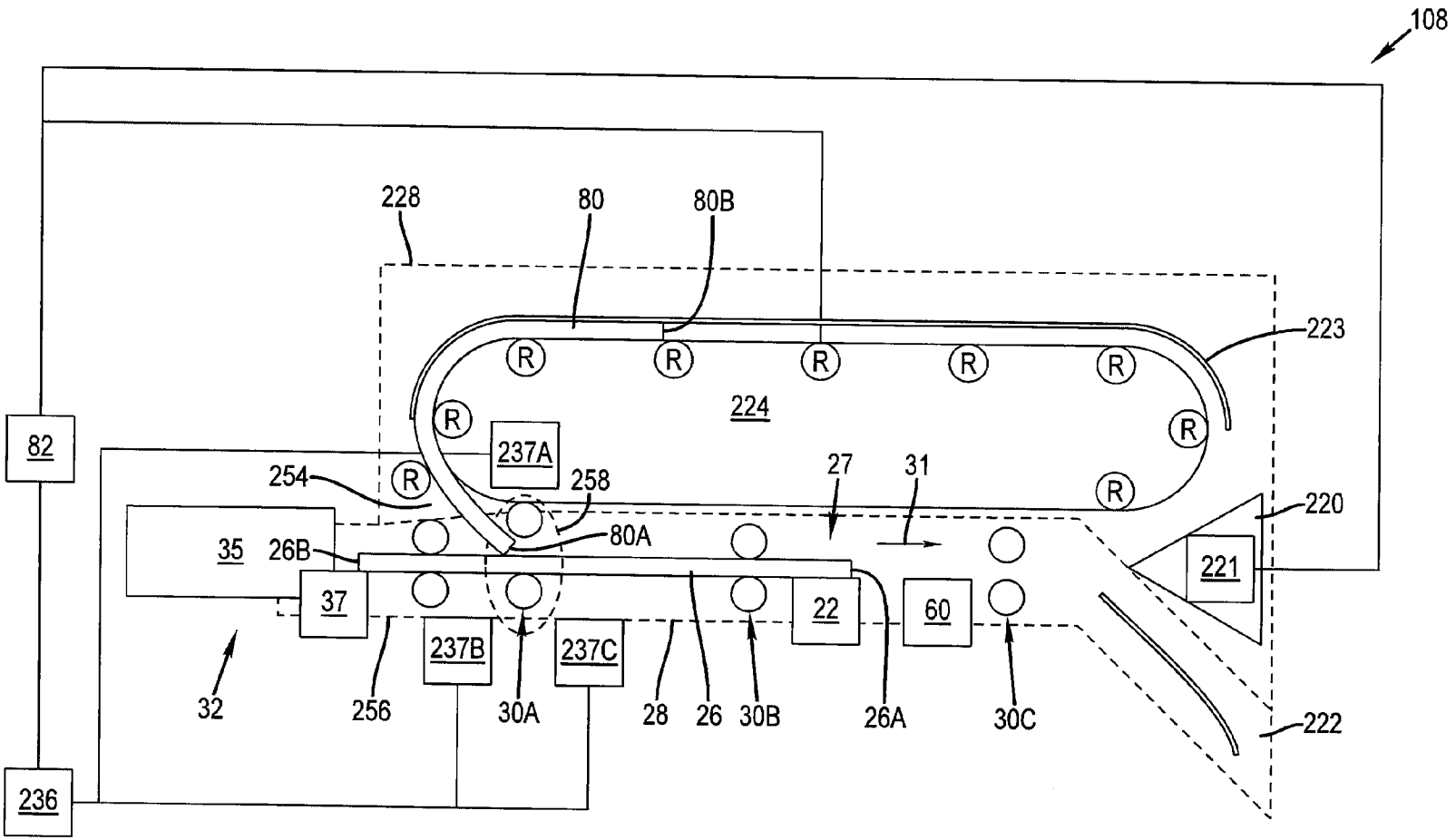
FIG. 14 shows the embodiment of FIG. 13 with a sheet in a recirculated position and a receiver being moved along a printing path.

As is shown in FIG. 14, recirculation system 228 provides a recirculation transport system 224 shown here as taking the form of a plurality of motor driven rollers R that are positioned within guides 223 to move receiver 26 and/or sheet 80 along recirculation system 228. Printer controller 82 sends signals to recirculation transport system 224 causing one or more of motorized drive rollers R to direct sheet 80 to reentry position 258 where sheet 80 is poised for entry into receiver transport system 28.

In this embodiment, position sensing system 236 provides first sensor 237A that can sense conditions in recirculation system 228 from which it can be determined when sheet 80 is positioned at a staging position 254 from which sheet 80 can be moved to reentry position 258 within a predetermined time. Position sensing system 236 also comprises sensors 237B and 237C that can sense the presence of a receiver 26 at various positions in receiver transport system 28 and that send signals to printer controller 82 from which printer controller 82 can predict the extent to which a portion of a receiver 26 will have moved past the reentry position 258 after the period of time required to move from the staging position 256.

In the embodiment of FIGS. 13 and 14 position sensing system 236 provides a first sensor 237A that detects when a first cross edge 80A of sheet 80 is positioned at a staging position 254 and a second sensor 237B that detects receiver 26 and a third sensor 237C that monitors the amount of rotation of first motorized rollers 30A. In other embodiments, position sensing system 236 can use other arrangements of sensors 237 to generate signals from which such information or equivalents of such information can be determined.

In this regard, it will be appreciated that in any of the embodiments described herein proximity sensor 54, sheet presence sensor 79, receiver sensing system 216 or position sensing system 218 or any of sensors 237 can comprise any type of sensor or sensor system known in the sensing arts that can sense a the presence of or movement of receiver 26, a sheet 80, or any condition that be used to determine of the presence or movement of receiver 26 and sheet 80 and can comprise without limitation any optical, mechanical, electrical, electro-magnetic sensors or other known sensing systems. In any embodiment any of these sensors can include line sensors that are arranged perpendicular to the cross edges so these sensors provide signals that can provide precise positioning information to printer controller 82 or area sensors that can provide signals to printer controller 82 from which printer controller 82 can determine the position or movement of receiver 26 or sheet 82.

Figure 15:
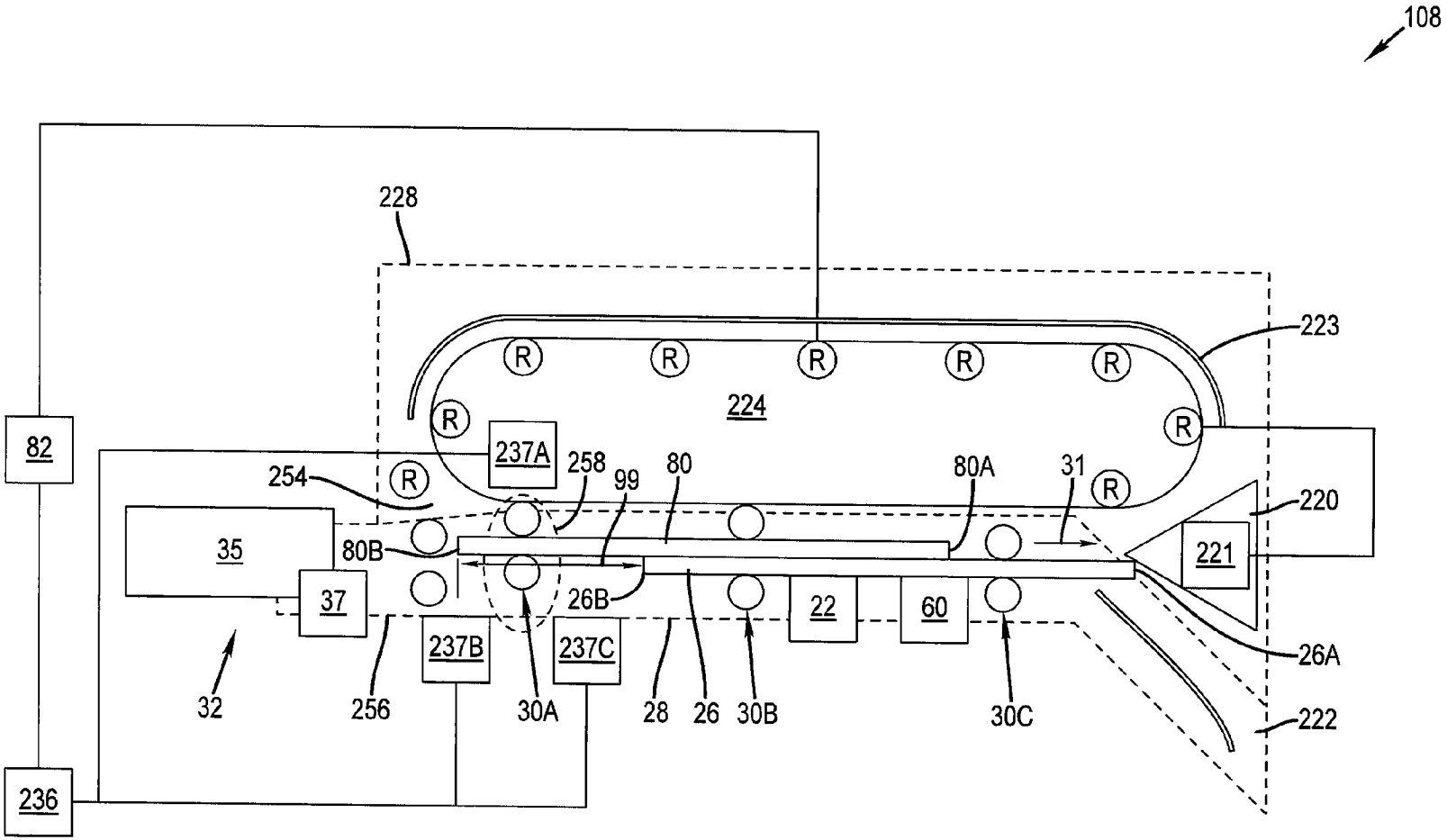
FIG. 15 shows the embodiment of FIGS. 13 and 14 with the receiver and sheet being moved along the printing path.
Figure 16:
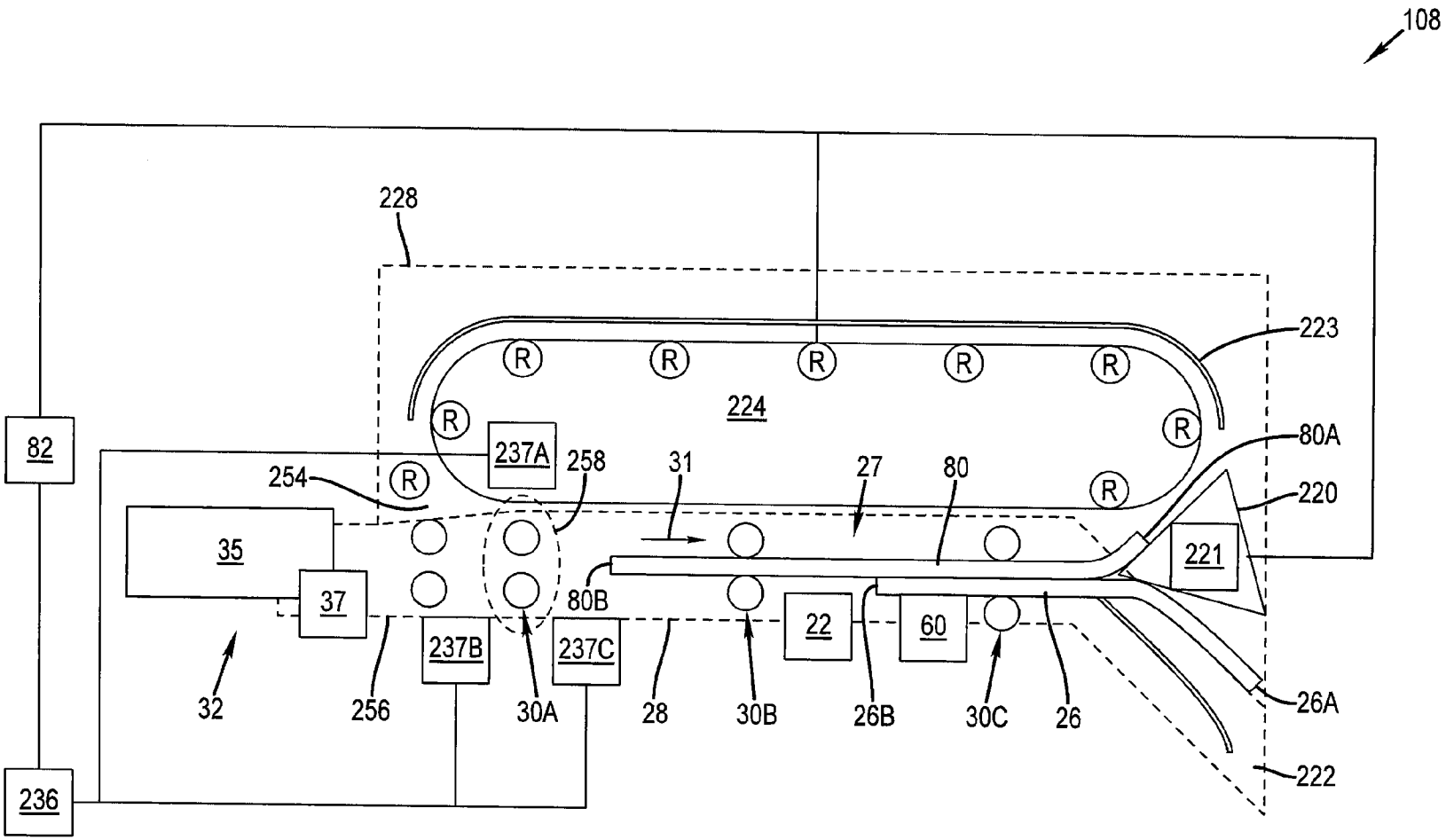
FIG. 16 shows the embodiment of FIGS. 13-15 with a diverter being operated to direct the printed receiver to an output path and the sheet for recirculation.

As is shown in FIG. 15, printer controller 82 uses the signals from position sensing system 236 to, measure, calculate or otherwise determine when to begin advancing sheet 80 into receiver transport system 28 at reentry position 258 to cause sheet 80 and receiver 26 to be positioned with receiver 26 with an amount of overlap required to provide a first unmasked portion 98 of sheet 80 having a first length 99 between second cross edge 26B of receiver 26 and second cross edge 80B of sheet 80.

Printer controller 82 then causes recirculation transport system 224 to drive sheet 80 to enter receiver transport system 28 at reentry position 258 and then causes receiver transport system 28 to move sheet 80 and receiver 26 in the overlapped arrangement past print engine 22 and fuser 60. As will be described later herein, the reentry of sheet 80 can be done with receiver 26 being stationary or moving.

In the embodiment of FIGS. 13-15, separation of receiver 26 from sheet 80 is performed by positioning diverter 220 in a first position shown in FIG. 15 as first cross edge 26A contacts diverter 220 and then repositioning diverter 220 to a second position shown in FIG. 15 before first cross edge 80A of sheet 80 reaches diverter 220. This causes receiver 26 to be directed into post-printing path 222 while sheet 80 is directed into recirculation system 228. It will be appreciated that recirculation system 228 can therefore reuse sheet 80 to help to allow additional prints to be made with images that extend to cross edges thereof but without consuming a new sheet 80 with each print. Alternatively, diverter 220 can be positioned at a single location that achieves separation when held at a single position.

In this embodiment, receiver delivery system 32 supplies both sheet 80 and receiver 26. In one embodiment of this type both sheet 80 and receiver 26 can comprise materials of the same type. In other embodiments, sheet 80 and receiver 26 can be different materials. In some embodiments sheet 80 can have coatings that receive toner in a manner that is less likely to result in toner offset in the event of reuse. In still other embodiments sheet 80 can be thinner than receiver 26 so as to limit the extent to which different processes or set points must be used when transferring a print image 25 to a receiver 26 that overlaps a sheet 80. For example, in one embodiment, sheet 80 can have a thickness that is equal to or less than a thickness of receiver 26. In a further embodiment, recirculation system 228 can have a sheet delivery system (not shown) that positions a sheet 80 directly into recirculation system 228.

Figure 17:
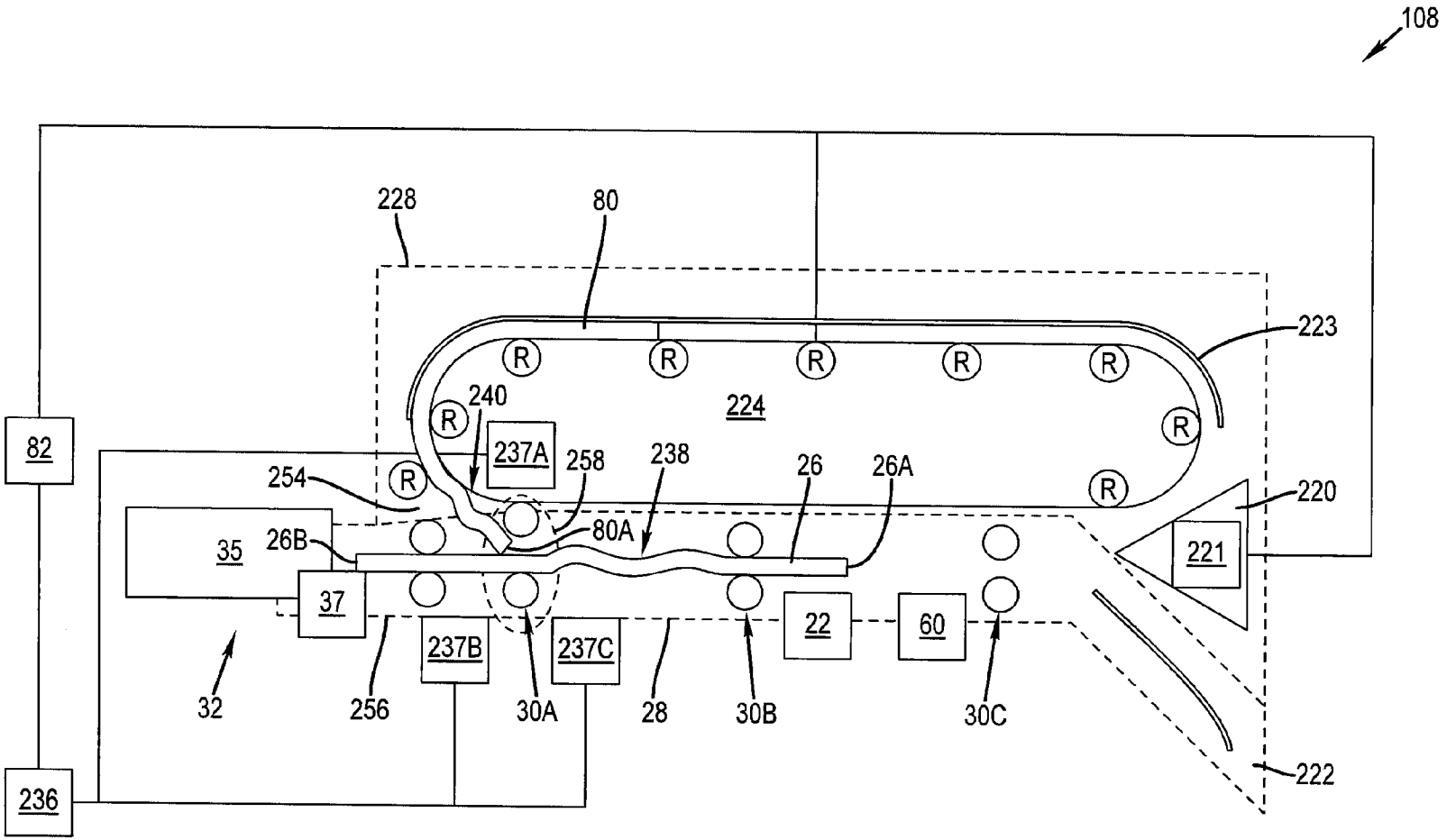
FIG. 17 shows the embodiment of FIGS. 13-16 operated in an alternate fashion.

As is shown in FIG. 17, in one embodiment a receiver transport system 28 provides a movable surface 30 in the form of first motorized rollers 30A positioned to form a nip at reentry position 258 where sheet 80 rejoins receiver 26, second motorized rollers 30B and third motorized rollers 30*c* that are positioned to provide more precise control of movement of sheet 80 and receiver 26 past print engine 22 and fuser 60. However, in this embodiment, printer controller 82 causes first motorized rollers 30A to move receiver 26 past first motorized rollers 30A at a rate of movement that is greater than a rate of movement provided by second motorized rollers 30B and third motorized rollers 30C. This causes a buckle 238 to form between first motorized rollers 30A and second motorized rollers 30B. Buckle 238 allows a period of time where movement of second cross edge 26B of receiver 26 toward first motorized rollers 30A can be temporarily stopped without interruption of the movement of first cross edge 26A or other portions of receiver 26. In this way transfer and fusing of a print image 25 can begin and/or continue at a desirable constant velocity while second cross edge of receiver 26 is temporarily halted at a fixed position. In one embodiment, this period of time is at least as long as the period of time required to move sheet 80 from a staging position 254 to reentry position 258.

In this embodiment, the movement of receiver 26 past first motorized rollers 30A is sensed by position sensing system 236 and stopped when a portion receiver 26 is positioned at a desired overlap position relative to sheet 80. Printer controller 82 then causes recirculation transport system 224 to move sheet 80 from staging position 254 toward the nip between first motorized rollers 30A such that first cross edge 80A of sheet 80 is positioned against a nip between first motorized rollers 30A.

Printer controller 82 can also optionally cause sheet 80 to be driven against first motorized rollers 30A while first motorized rollers 30A are stopped. This forms a buckle 240 in sheet 80 that generates a force to thrust first cross edge 80A of sheet 80 against motorized rollers 30A and receiver 26 before motorized rollers 30A again begin moving. Buckle 240 stores potential energy that can be released when motorized rollers 30A starts rotating to ensure that first cross edge 80A is evenly positioned against first motorized rollers 30A across the width of first cross edge 80A. This protects against the possibility that sheet 80 will be skewed relative to receiver 26 when receiver 26 begins to move through motorized rollers 30A.

Figure 18:
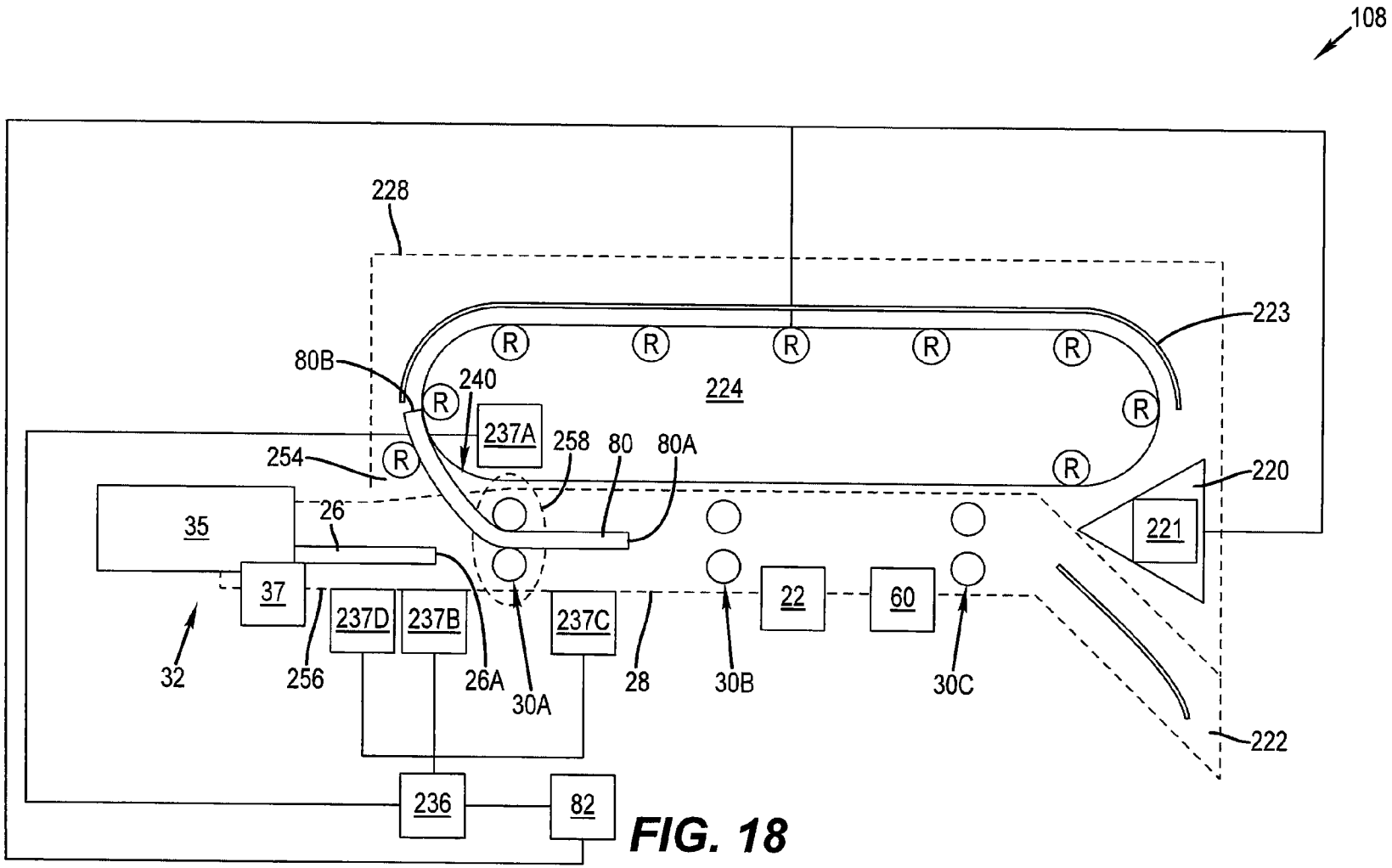
FIG. 18 shows the embodiment of FIGS. 13-16 operated in another alternate fashion.

FIG. 18 shows an embodiment of overlap positioning system 108 that operates generally in the same fashion the embodiment shown in FIGS. 11-17. However, in this embodiment, printer controller 82 causes sheet 80 to pass through reentry position 258 at the nip between first motorized rollers 30A before advancing receiver 26 from a staging position 256 through reentry position 258.

In this embodiment, position sensing system 236 provides a sensor 237D that can sense conditions in receiver transport system 28 and from which it can be determined when receiver 26 is positioned at staging position 256. Staging position 256 is arranged to be located relative to reentry position 258 so that a first cross edge 26A of receiver 26 can be moved from staging position 256 to reentry position 258 within a predetermined time. Position sensing system 236 sends signals to printer controller 82 indicating when sensor 237D senses conditions indicating that receiver 26 is at staging position 256.

Printer controller 82 causes sheet 80 to be advanced into and at least partially through a nip between motorized rollers 30A. Printer controller 82 uses motorized rollers 30A and optionally, second motorized rollers 30B and third motorized rollers 30C to advance sheet 80 through reentry position 258 to a predetermined extent. As is noted above, printer controller 82 can determine an amount of movement of sheet 80 through reentry position 258 based upon signals from position sensing system 236 including a first sensor 237A that detects when first cross edge 80A of sheet 80 is positioned at a staging position 254, a second sensor 237B that detects when receiver 26 reaches the reentry position 258 and a third sensor 237C that monitors an amount of rotation of first motorized rollers 30A to determine an amount of a sheet 80 that has moved past first motorized rollers 30A.

Printer controller 82 uses the signals from position sensing system 236 to measure, calculate or otherwise determine when first cross edge 26A of receiver 26 can be moved from staging position 256 to reentry position 258 to cause receiver 26 to overlap sheet 80 at first cross edge 26A to form an unmasked portion of sheet 80 having at least a first length 97 between first cross edge 80A of sheet 80 and first cross edge 26A of receiver 26. Thereafter printer controller 82 causes first motorized rollers 30A, second motorized rollers 30B and third motorized rollers 30C to advance sheet 80 and receiver 26 past print engine 22 and fuser 60, toward diverter 22.

Printer controller 82 and position sensing system 236 can determine the amount of overlap in a variety of ways. For example, in one embodiment, the amount of overlap is established based upon receiver position sensing system that are positioned to sense movement of the sheet 80 past a fixed point and movement of second cross edge 26B of receiver 26 to the fixed point. When sheet 80 has reached a predetermined position, printer controller causes receiver 26 to be advanced to reentry position 258 and to begin overlapping sheet 80 the nip between motorized rollers 30A with sheet 80.

In other embodiments position sensing system 236 can use other arrangements of sensors 237 to generate signals from which printer controller 82 can determine such information or equivalents of such information. Position sensing system 236 can include any type of sensor 237 that can sense a receiver or sheet 80 or measure conditions indicative of movement of a receiver 26 or sheet 80, or that can sense conditions from which a position of a receiver 26 or sheet 80 or amount of movement of a receiver 26 or sheet 80 can be determined and can comprise without limitation an optical, mechanical, electrical, electro-magnetic sensors, for example.

In another embodiment, printer controller 82 can determine an amount of overlap based upon the signals sent from sensors 237 that can sense the position or movement of a sheet 80 to a fixed point and that can further measure movement of the receiver 26 to a position relative to the fixed point.

In still another embodiment, printer controller 82 can determine the amount of overlap using a position sensing system 236 that captures electronic images of receiver 26 and overlapped sheet 80 while printer controller 82 cooperates with overlap positioning system 108 to define the extent of the overlap. In one example of such an embodiment printer controller 82 causes an initial amount of overlap to be established by positioning sheet 80 and receiver 26 in a position where trailing edge 26A of receiver 26 overlaps a leading edge of sheet 80 and uses signals from position sensing system 236 to sense a distance between a first cross edge 26A of receiver 26 and second cross edge 80B of sheet 80 in order to determine an extent of an overlap. Where this is done, printer controller 82 cooperates with overlap positioning system 108 and receiver transport system 28 to adjust the relative positions of sheet 80 and receiver 26 to achieve a desired extent. Other known techniques can be used to define the extent of the overlap.

In further embodiments, the amount of the overlap can be established by providing fiducial markings or other types of machine detectable fiducial features, deposits or structures on receiver 26 and sheet 80 that can be detected by a position sensing system 236 using sensors 237 that are adapted to detect the fiducial markings. Such sensors can generate signals that can be used by printer controller 82 to help ensure that a desired overlapping condition is achieved.

Overlap positioning system 108 can be incorporated in a printer 20 or supplied as an add-on modular feature or upgraded for use with a printer 20. In a modular or add on embodiment, generally any functions ascribed to printer controller 82 herein can be performed by an optional local control circuit or control system 83 as described above. Optionally local controller 83 can have communication circuit (not shown) that can communicate with printer controller 82 from which printer controller 82 can provide information from which it can be determined that local controller 83 is to cause a print to be made that has an image that extends to a cross edge of a receiver that is to be used for printing.

As is shown in FIG. 18, an overlap positioning system 108 having a recirculation system 228 and an appropriate arrangement of sensors 237 and a position sensing system 236, a printer controller 82 can cause a receiver 26 to overlap a sheet 80 with a receiver 26 at a second cross edge 80B to provide, a print having an image that extends first cross edge 26A.

Overlap positioning system 108 can also be used in other ways to position a cross edge of a receiver 26 to which an image is to extend relative to a sheet 80. For example, in one alternative embodiment, illustrated in FIG. 19, printer controller 82 can determine that a receiver 26 is to have an image that extends both to first cross edge 26A and to second cross edge 26B, receiver 26 can be positioned with a first cross edge 26A positioned on a sheet 80 and with a second cross edge 26B positioned on a second sheet 81.

Figure 19:
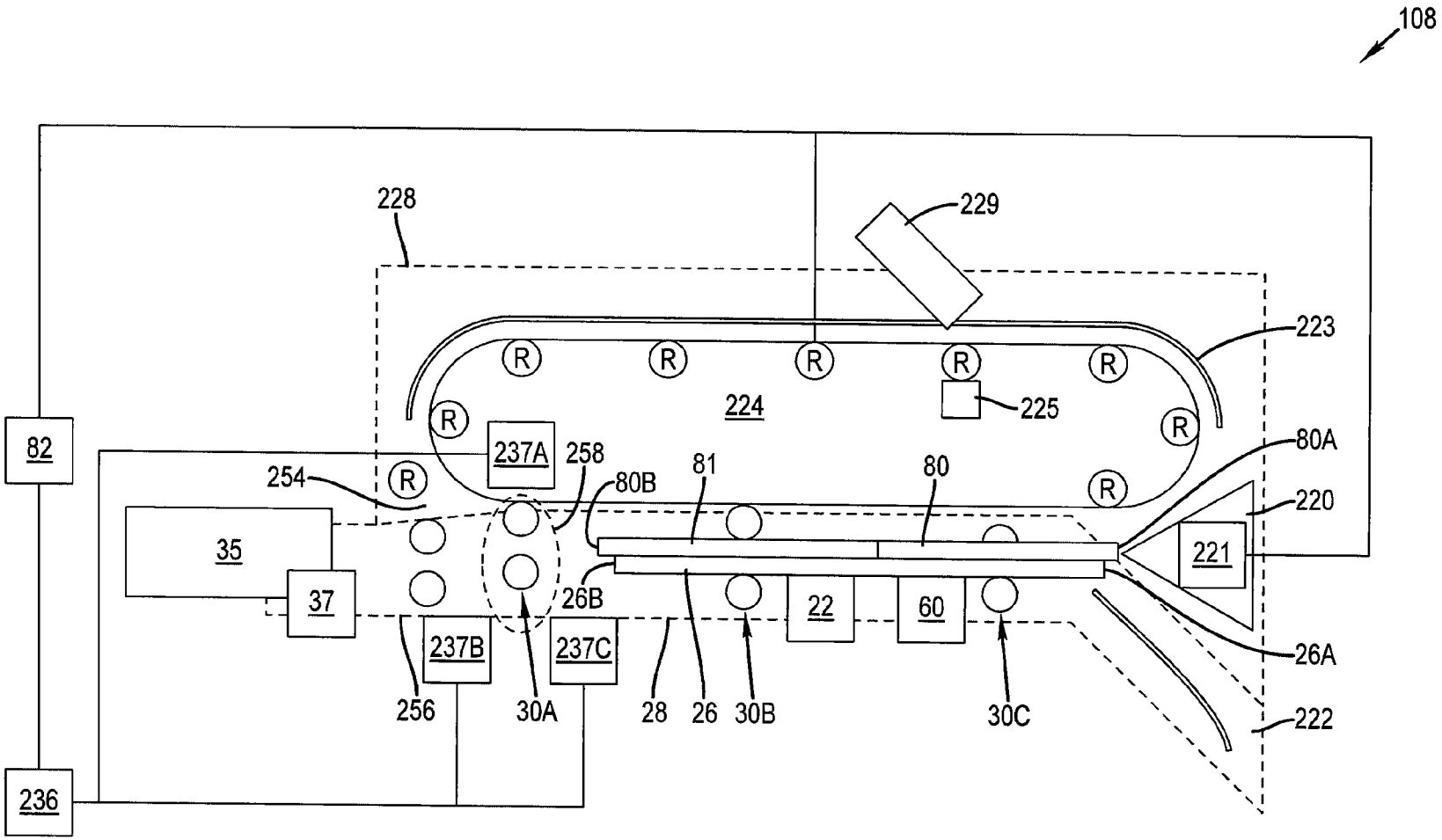
FIG. 19 shows an alternate embodiment of a recirculation system operated to provide a prints having an image that extends to a cross edge of the print and that uses two sheets.
Figure 20:
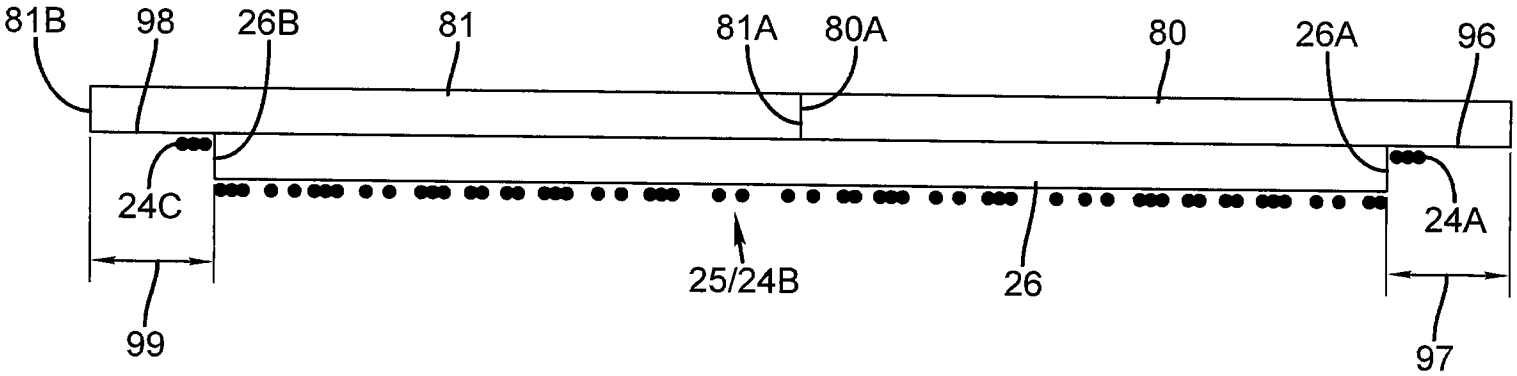
FIG. 20 a positional relationship of a receiver and two sheets in the embodiment of FIG. 19.

As is shown in FIG. 19 and as is also shown in FIG. 20, which illustrates a positional relationship of receiver 26, sheet 80, sheet 81, both of first sheet 80 and second sheet 81 are positioned abutting each other when masked during printing of a receiver 26 and provide a first unmasked portion 96 and a second unmasked portion 98 on which toner 24 may be deposited during a first printing. As is known in the printing industry toner can act as an adhesive when positioned between for example, a sheet and a receiver during fusing. Accordingly, as is shown in FIG. 20, during transfer of a toner 24 forming print image 25 a first portion 24A of toner 24 may be positioned on sheets 80, while a second portion 24B of toner 24 is positioned on receiver 26 to form print image 25 while a third portion 24C of toner 24 may be positioned on sheet 81.

If sheets 80 and 81 are reused with a subsequent receiver, there is a risk that sheet 80 or sheet 81 will be bound to a subsequent receiver there is a risk that the second receiver will be positioned on either of sheet 80 or sheet 81 with toner 24 between sheet 80 and sheet 81 can fuse thereto. In one embodiment, this risk can be eliminated by discarding sheet 80 and sheet 82, such as by diverting sheet 80 and 82 into an embodiment of recirculation system 228 having a second diverter 225 (shown here as an actuator 227 that can move a motorized roller R to a position that directs sheets 80 and 81 to exit path 229 shown in the embodiment of FIG. 19.

Figure 21:
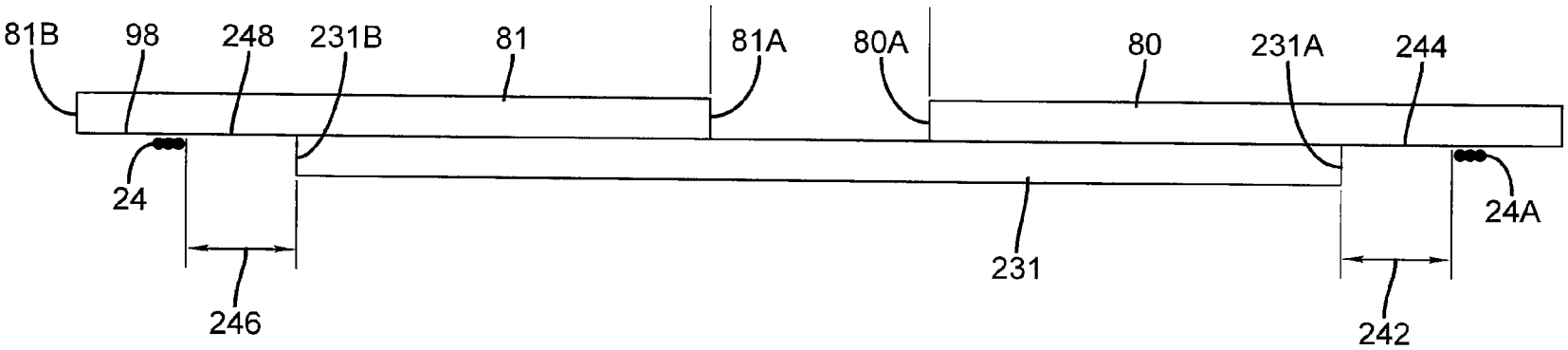
FIG. 21 shows another positional relationship of a receiver and two sheets useful in one embodiment.

However, as is shown in FIG. 21 in an alternative embodiment both sheet 80 and sheet 81 can be recirculated for use with a subsequent receiver 231 without creating a risk that toner 24 from a previous printing operation will be positioned between sheet 80, sheet 81 and subsequent receiver 231. As is illustrated in FIG. 21, in this embodiment, sheet 80 is indexed so that there is a first additional separation 242 between first cross edge 231A of subsequent receiver 231 and first cross edge 80A of sheet 80 providing an additional unmasked portion 244 of sheet 80 that separates subsequent receiver 231 from first unmasked portion 96 which may bear first portions 24A of toner 24 deposited on sheet 80 during the printing of receiver 26. As is also illustrated in FIG. 21, in this embodiment, sheet 81 is also indexed so that there is a second additional separation 246 between second cross edge 231B of subsequent receiver 231 and second cross edge 81A of sheet 80 providing an additional unmasked portion 248 of sheet 80 that separates subsequent receiver 231 from second unmasked portion 98 which may bear third portions 24C of toner 24 deposited on sheet 80 during the printing of receiver 26.

The length of first additional separation 242 and second additional separation 246 can vary according to the characteristics of printer 20, receiver 26 and sheet 80 used in a particular printing operation and can be determined based upon experimental testing or calculation. In the embodiment that is illustrated here, sheet 80 and sheet 81 are indexed during printing of the subsequent receiver 231 so that first additional separation 242 is about equal to first length 97 and so that second additional separation 244 is about equal to second length 99. In this way, sheets 80 and 81 can be reused without risk that toner that is fused to sheet 80 or sheet 81 during the printing of the first receiver will fuse to the back side of a subsequent receiver. It will be appreciated that a similar indexing approach can be applied to allow sheets 80 and 81 to be used with more than two receivers.

Figure 22:
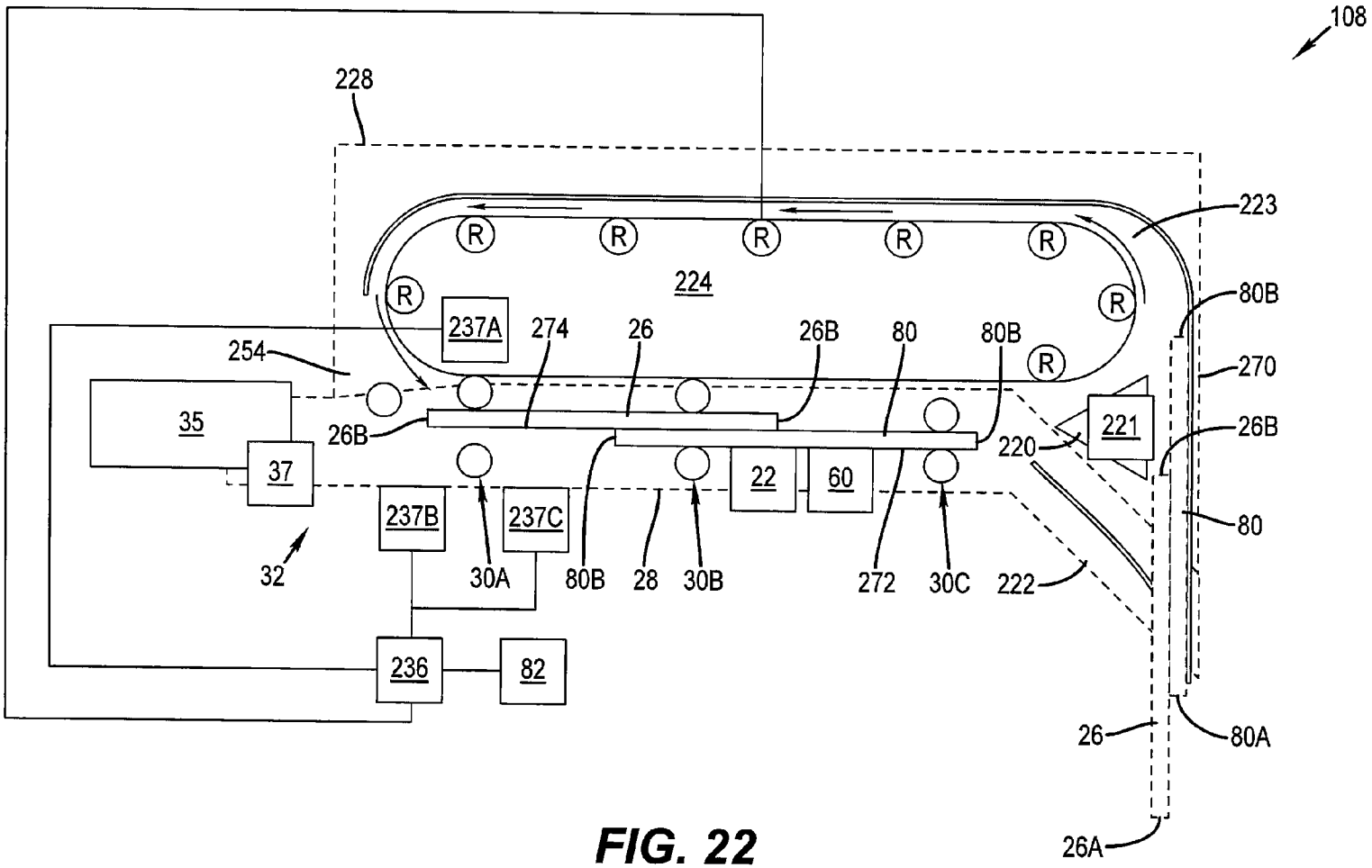
FIG. 22 shows another embodiment where a recirculation system inverts the sheet and receiver allowing a first printed receiver to act as a sheet.

As is shown in phantom in FIG. 22, in another embodiment printer controller 82 can cause a receiver 26 and sheet 80 to be guided by diverter 220 to pass into post-printing path 222 and pass through recirculation system 228 (arrows) through a second pathway 270 that presents an unprinted side 272 of sheet 80 and an unprinted side 274 of receiver 26 to print engine 22 and fuser 60 when receiver 26 and sheet 80 are recirculated. This enables sheet 80 and receiver 26 to switch functions so that a reverse side of a first printed receiver 26 can act as a sheet and to allow a sheet 80 to be printed as a second printed receiver.

Figure 23:
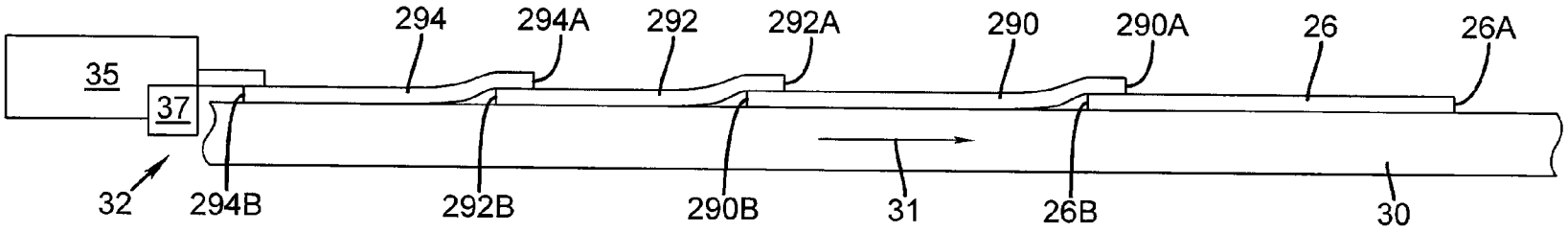
FIG. 23 shows another alternate embodiment in which separate receivers act both as a sheet and as a receiver.
Figure 25:
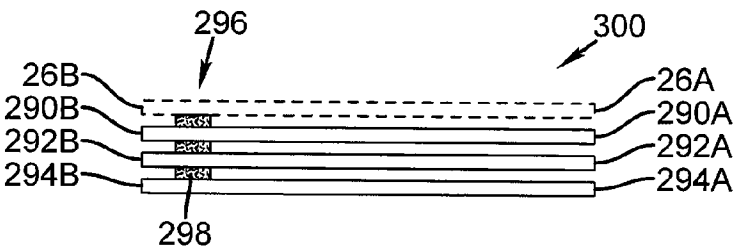
FIG. 25 shows one embodiment of a printed product made using sheets printed accordance with the embodiment of FIG. 21.
Figure 24:
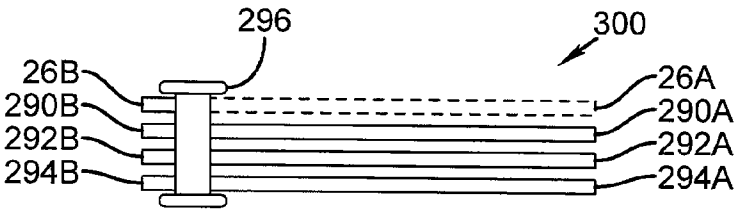
FIG. 24 shows one embodiment of a printed product made using sheets printed accordance with the embodiment of FIG. 21.

In a further embodiment shown in FIGS. 23, 24 and 25 a portion of each receiver 26 can be used as a sheet. Here what is shown is a sheet delivery system 72 that delivers a sequence of receivers 26, 290 and 292 with a leading receiver having a previously formed toner image with a second cross edge 26B on that masks a first cross edge 290A of a second receiver 290. Second receiver 290 has a second cross edge 290B and is positioned to mask first cross edge 292A of a third receiver 292.

This allows receivers 290, 292, and 294 to having images that extend to a first cross edge 290A, 292A, and 294A respectively and on which second cross edges 290B, 292B and 294B can be positioned. It will be appreciated that such an approach is particularly advantageous where the first cross edges are used in an imaging product that does not require that the areas that are proximate to first cross edges are not visible, such as a bound printed product like a photo book. As is shown in FIG. 24, second cross edges 26B, 292B, 292B, and 294B can be aligned and a fastener 296 can be driven therethrough yielding a bound printed product 300 such as a photo book or other book having image content that extends to first cross edges 290A, 292A and 294A without a cross cutting operation. As is also shown in phantom in FIG. 24, receiver 26 can optionally be used as a part of bound printed product 300.

Alternatively, FIG. 25, shows another embodiment of this type, however, here fastener 296 is formed from toner 24. In this embodiment of this type, the transferring of print image 25 includes transferring at least a minimum amount of binding toner on receivers 26, 290, 292, 294 and 296 adjacent second cross edges 26B, 290B, 292B, and 294B of receivers 26, 290, 292 and 294. Receivers 26, 290, 292, and 294 are then stacked as shown in FIG. 25 to align the regions having binding toner 298. Binding toner 298 can then be fused so to hold receivers 26, 290, 292 and 294 to others of receivers 26, 290, 292 and 294 that are stacked with toner bearing regions therebetween. This allows the formation of a bound printed product 300 while securing additional binding toner in the form of any toner that is transferred through misalignment.

It will be appreciated that in addition to the above described advantages of the printers, printing modules and methods that are described herein, such printers, printing modules and methods can also be used to advantageously form borderless prints of a receiver such as receiver 26 non-straight cross edges. For example, FIG. 26 shows a top down view of a receiver 26 having a non-straight first cross-edge 26A and a non-straight second cross edge 26B positioned on a sheet 80 prior to printing.

Figure 27:
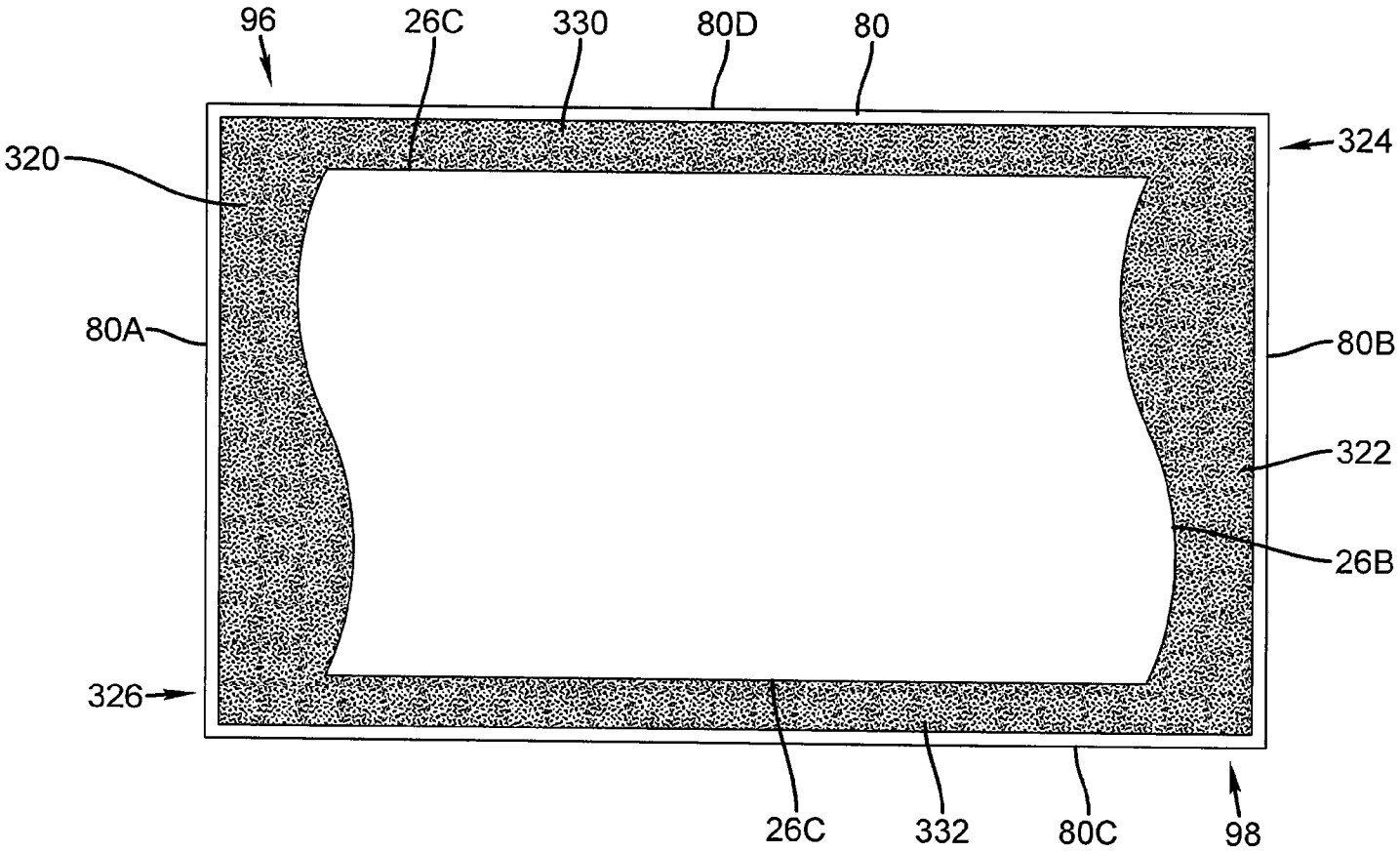
FIG. 27 shows a top down view of the sheet of FIG. 26 after printing.
Figure 28:
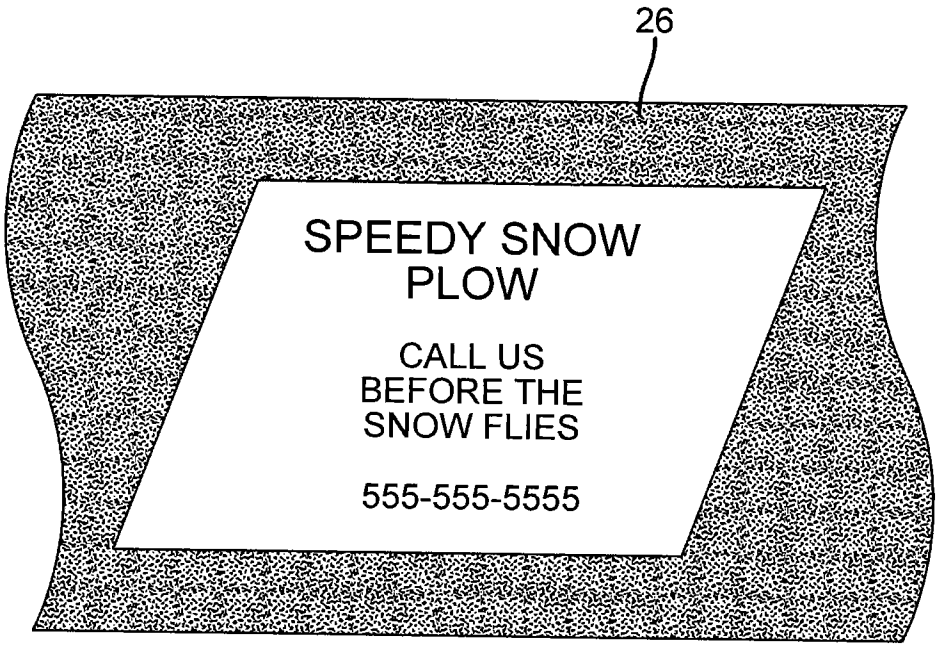
FIG. 28 shows a top down view of the receiver of FIG. 26 after printing.

FIG. 27 shows a top down view of a sheet 80 after printing with a first portion 320 of print image 25 being transferred onto unmasked portion 96 of sheet 80 near first cross edge 80A of sheet 80 and with a second portion 322 of print image 25 being transferred onto unmasked portion 98 of sheet 80A, and with the balance of print image 25 being positioned receiver 26 and extending from first cross edge 26A to second cross edge 26B of receiver 26.

Figure 26:
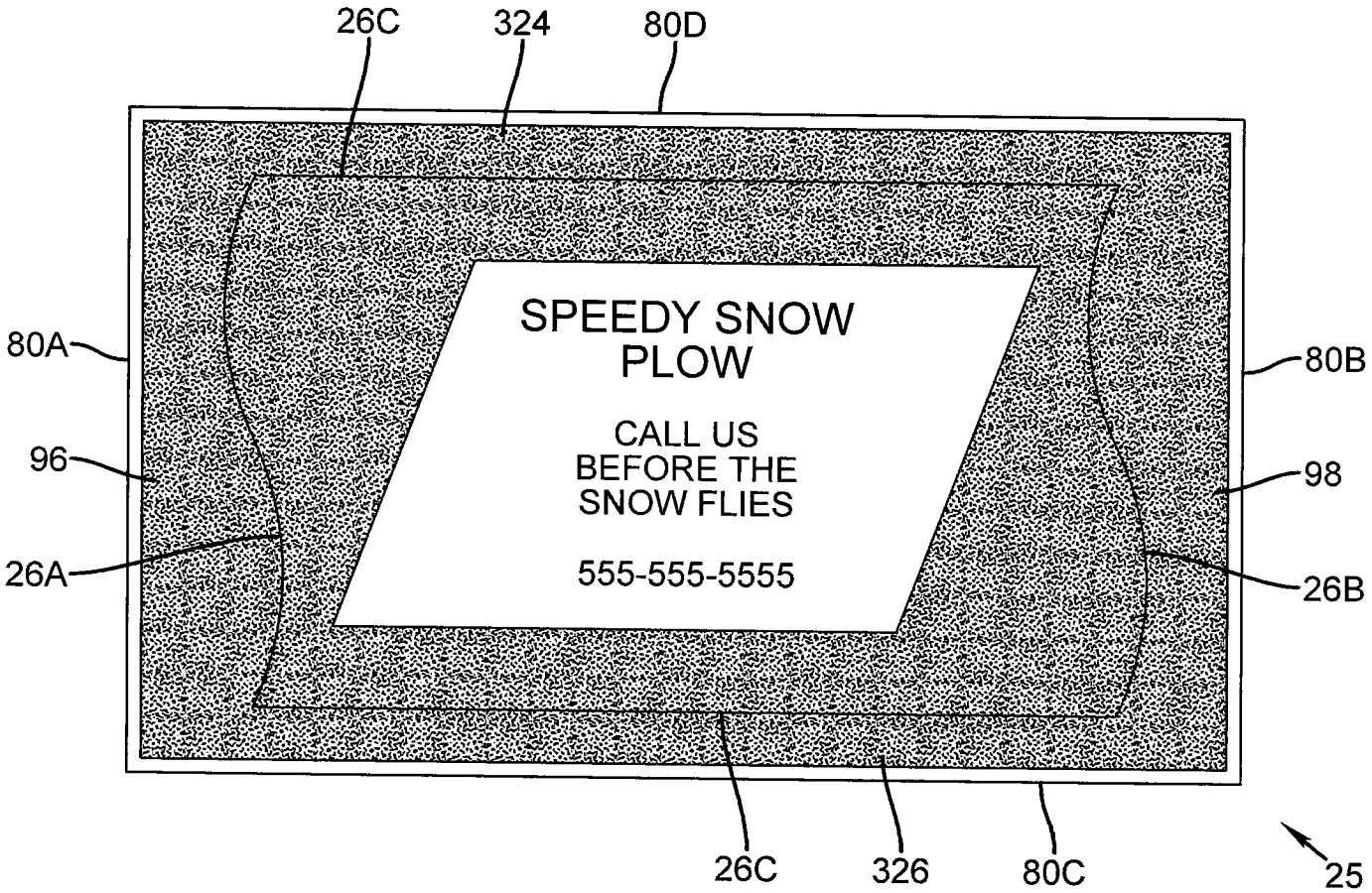
FIG. 26 shows a top down view of a receiver having a non-straight edge positioned on a sheet prior to printing.

As is also illustrated generally in FIGS. 26, 27 and 29, in any of the above described embodiments, receiver 26 can also optionally be positioned with lateral edges 26C and 26D positioned to mask sheet 80 along lateral edges 80C and 80D to allow a print image 25 to extend to lateral edges of receiver 26 without cutting or trimming operations and providing as shown, unmasked portions 324 and 326 of sheet 80 that can receive portions 330 and 332 of toner 24 of print image 25 that are not transferred onto receiver 26.

In the above described embodiments, print engine 22 has been described as being a print engine 22 that transfers toner 24 to form images. In other embodiments, the methods and apparatuses that are described herein can be used with other forms of print engines 22 that form a print image 25 using the transfer of materials onto a receiver, including but not limited to ink, thermal transfer materials, toners and any other materials that can be patterned for use in forming structures, circuits, optical paths and the like.

What is claimed is:

1. A method for operating a printer comprising the steps of:

providing a sheet in a printing path leading to a printing area;

providing a receiver in the printing path having a cross edge to which a printed image is to extend positioned across the printing path for movement with the sheet; and, moving the receiver and the sheet through the printing area so that the cross edge is moved through printing area during transfer of a toner to form of the print image;

forming image data that is intended to be printed on the receiver;

wherein the receiver and the sheet are moved through the printing area with the cross edge of the receiver positioned on the sheet to form a portion of the sheet that is masked from transfer of the print image from an unmasked portion of the sheet and wherein the unmasked portion of the sheet is positioned to receive any portion of the print image that is transferred when the receiver is not in the printing area which permits catching excess toner by the unmasked portion of sheet that was intended for the receiver thereby eliminating contamination of the printer.

2. The method of claim 1, wherein the cross edge is a trailing edge of the receiver as the receiver is moved along the printing path and wherein the receiver is positioned on the sheet with the trailing edge of the receiver at the separation distance ahead a leading edge of the sheet as the sheet and receiver are moved along the travel path.

3. The method of claim 1, further comprising using a diverter which separates the sheet and the receiver after transfer of the toner to the receiver.

4. The method of claim 1, wherein the sheet is recirculated for subsequent use and is indexed relative to a subsequent receiver used during said subsequent use to prevent toner from a previous print image that transferred to the sheet during a previous use of the sheet from binding to a second receiver.

5. The method of claim 1, wherein the sheet comprises a previously printed leading receiver having with a trailing edge on which a leading cross edge of the receiver is positioned.

6. The method of claim 5, wherein the print image is positioned for transfer so that there is at least a minimum portion of the print image is transferred onto the leading receiver and wherein the leading receiver and the receiver are stacked and heated along the trailing edges thereof so that toner from the print image at the trailing edge of the leading receiver trailing edge fuses between the leading receiver and the receiver to hold the leading receiver to the receiver.

7. The method of claim 1, wherein the sheet comprises a trailing receiver having a leading edge on which a trailing edge of the receiver is positioned.

8. The method of claim 7 wherein the print image positioned to transfer at least a minimum portion of the print image onto the following receiver that can be positioned between the receiver and the following receiver to be fused again to bind the following receiver to the receiver and wherein the trailing receiver and the receiver are stacked and heated along the trailing edges thereof so that toner from the print image at the leading edge of the trailing receiver fuses between the trailing receiver and the receiver to hold the trailing receiver to the receiver.

9. The method of claim 1, wherein the sheet has a thickness that is equal to or less than a thickness of the receiver.

10. The method of claim 1, wherein the movement of the receiver and sheet are controlled to position the sheet within a range of possible positions of transfer for the print image.

11. The method of claim 1, wherein the movement of a print image is controlled to position the print image so that the print image will be transferred up to a cross edge of the receiver when the cross edge of the receiver is within any of a range of positions relative to the print image during transfer.

12. The method of claim 1, further comprising the step of verifying that a receiver having a cross edge to which a print image is to extend is positioned on a sheet before transferring the print image.

13. The method of claim 1, further comprising inverting the receiver and sheet so that the sheet masks the receiver and providing a print image on the receiver.

14. The method of claim 1, wherein the receiver has a cross edge that is non-linear, wherein the print image is to extent to the non-linear edge of the receiver.

15. The method of claim 1, wherein it is determined when the receiver will be positioned at the transfer area and the print image is positioned so the transfer surface so that the print image is transferred as the cross edge of the receiver passes through the transfer area.

16. The method of claim 1, wherein it is determined when the print image will be positioned at the transfer area and the receiver transport system is caused to move the receiver and the sheet so that the cross edge of the receiver travels through the transfer area as the print image is being transferred wherein the sheet is positioned so that a cross edge of the sheet corresponding to the cross edge of the receiver travel through the transfer area at a time when print image is not being transferred.

* * * * *